US009736577B2

(12) United States Patent
Yamamoto et al.

(10) Patent No.: US 9,736,577 B2
(45) Date of Patent: Aug. 15, 2017

(54) SPEAKER ARRAY APPARATUS

(71) Applicant: Yamaha Corporation, Hamamatsu-shi, Shizuoka (JP)

(72) Inventors: Masaki Yamamoto, Hamamatsu (JP); Susumu Takumai, Hamamatsu (JP); Kazunori Tanaka, Hamamatsu (JP); Yuichi Sugisaki, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 15/053,601

(22) Filed: Feb. 25, 2016

(65) Prior Publication Data

US 2016/0255434 A1 Sep. 1, 2016

(30) Foreign Application Priority Data

Feb. 26, 2015 (JP) ..... 2015-036968

(51) Int. Cl.
*H04R 5/02* (2006.01)
*H04R 1/02* (2006.01)
(Continued)

(52) U.S. Cl.
CPC ..... *H04R 1/403* (2013.01); *H04R 1/288* (2013.01); *H04R 3/12* (2013.01); *H04S 3/008* (2013.01);
(Continued)

(58) Field of Classification Search
CPC ..... H04R 1/403; H04R 3/12; H04R 1/288; H04R 2203/12; H04R 2201/401; H04R 5/04
(Continued)

(56) References Cited

U.S. PATENT DOCUMENTS 5,953,432 A * 9/1999 Yanagawa ..... H04R 1/403 381/335
9,154,879 B2 * 10/2015 Yoo ..... H04R 5/04
(Continued)

FOREIGN PATENT DOCUMENTS

CN 1666566 A 9/2005
CN 101288338 A 10/2008
(Continued)

OTHER PUBLICATIONS

European Search Report issued in counterpart European Application No. 16157463.7 dated Jul. 1, 2016 (11 pages).
(Continued)

*Primary Examiner* — Thjuan K Addy
(74) *Attorney, Agent, or Firm* — Crowell & Moring LLP

(57) ABSTRACT

A speaker array apparatus includes an apparatus housing having a disposition plane, and a speaker array which includes a plurality of speakers disposed at least in a vertical direction on the disposition plane of the apparatus housing that is opposite to a listening position. The speaker array apparatus receives and distributes a sound signal input from an outside to all of or a part of the speakers of the speaker array, and outputs the distributed sound signal as a sound beam by controlling an output timing of each sound output from the all or part of the speakers. Each speaker of the speaker array has an appropriate output direction in an elevation angle, the appropriate output direction indicating a direction having largest sound pressure in a sound pressure distribution when the sound is output from the speaker.

11 Claims, 14 Drawing Sheets

(51) Int. Cl.

| | |
|---|---|
| ***H04R 9/06*** | (2006.01) |
| ***H04R 1/40*** | (2006.01) |
| ***H04S 3/00*** | (2006.01) |
| ***H04R 1/28*** | (2006.01) |
| ***H04R 3/12*** | (2006.01) |
| *H04S 7/00* | (2006.01) |

(52) U.S. Cl.
CPC .... *H04R 2201/401* (2013.01); *H04R 2203/12* (2013.01); *H04S 7/30* (2013.01)

(58) Field of Classification Search
USPC ..... 381/305, 300, 335, 117, 336
See application file for complete search history.

(56) References Cited

U.S. PATENT DOCUMENTS

| | | | | |
|---|---|---|---|---|
| 2005/0217927 | A1* | 10/2005 | Noselli | G10K 11/20 181/191 |
| 2006/0126878 | A1 | 6/2006 | Takumai et al. | |
| 2006/0153407 | A1 | 7/2006 | Keele, Jr. et al. | |
| 2007/0019831 | A1 | 1/2007 | Usui | |
| 2014/0126753 | A1 | 5/2014 | Takumai et al. | |
| 2015/0382108 | A1 | 12/2015 | Takumai et al. | |

FOREIGN PATENT DOCUMENTS

| | | | |
|---|---|---|---|
| CN | 103636238 | A | 3/2014 |
| EP | 1 662 842 | A1 | 5/2006 |
| JP | 2004-363695 | A | 12/2004 |

OTHER PUBLICATIONS

Chinese-language Office Action issued in counterpart Chinese Application No. 201610108422.X dated Jun. 2, 2017 with English translation (15 pages).

* cited by examiner

SPEAKER ARRAY APPARATUS

CROSS REFERENCE TO RELATED APPLICATION(S)

This application is based upon and claims the benefit of priority of Japanese Patent Application No. 2015-36968 filed on Feb. 26, 2015, the contents of which are incorporated herein by reference in its entirety.

BACKGROUND OF THE INVENTION

1. Field of the Invention

The present invention relates to a speaker array apparatus which can output a sound beam by a speaker array including a plurality of speakers.

2. Description of the Related Art

In the related art, a speaker array apparatus uses a technology which strengthens acoustic energy in the vicinity of a focal point by in-phase adding, and as a result, makes a sound beam having strong directivity in the direction of the focal point, by outputting the same audio signals from a plurality of speakers disposed in line or plane, to make the audio signals reach the focal point in a space at the same time by adding slightly different delay time.

As techniques related to such a speaker array apparatus, for example, a technique described in JP-A-2004-363695 as Patent Literature 1 is known. The speaker array apparatus described in Patent Literature 1 performs deferred processing with respect to each of the audio signals of a multi-channel (for example, a center channel (Cch), a front left channel (Lch), a front right channel (Rch), a sound left channel (SLch), or sound right channel (SRch)), and by adding the deferred signal and supplying the signal to the speakers in all of the channels, different directivities are given to each of the sound beams related to the multi-channel, and the sound beams are output at the same time.

In addition, the speaker array apparatus described in Patent Literature 1 can make the sound beams related to each channel reach a listening position from various directions by reflecting each of the sound beams related to the multi-channel to a wall surface of an installation space, such as a room, and an excellent sound effect is given to a listener who is positioned at the listening position.

Patent Literature 1: JP-A-2004-363695

SUMMARY OF THE INVENTION

Here, in surround sound, an aspect of adding a height channel which is oriented to the listening position from left and right upper parts of the apparatus, to sound field expression in a horizontal direction, such as the speaker array apparatus described in Patent Literature 1, is known. According to the aspect of adding the height channel, since the sound field expression related to a direction of height or depth is possible, it is possible to realize more advanced sound field expression.

Similar to the speaker array apparatus described in Patent Literature 1, a case of a configuration in which the height channel can be output by the sound beam is considered. As described above, since it is necessary to output the sound related to the height channel to the listening position from the front upper part, it is desirable that the sound beam related to the height channel is output to reach the listening position after being reflected on a ceiling surface, and it is necessary to output the sound beam from the speaker array apparatus for making a certain elevation angle.

In this regard, in the speaker array apparatus described in Patent Literature 1, each speaker which configures the speaker array is attached to a disposition plane which has a shape of a plane that perpendicularly extends, and in general, there is a tendency for sound pressure to decrease as going in a direction which is horizontal to the disposition plane. Therefore, when each speaker is disposed similar to the speaker array apparatus described in Patent Literature 1, since the sound pressure decreases in a direction of making a predetermined elevation angle, it is assumed that the sound pressure of the sound beams output in the direction of making the elevation angle is not sufficient, and sufficient directivity cannot be ensured. In this case, in the speaker array apparatus, a case where sufficient sound field expression cannot be performed by the sound beam related to the height channel can be generated.

Furthermore, in each speaker which configures the speaker array, in the vicinity of the center of the speakers, high pressure is exhibited in a direction which is vertical to the disposition plane, and strong directivity is exhibited. Therefore, similar to the speaker array apparatus described in Patent Literature 1, when disposing the speaker array, it is assumed that the sound pressure of the sound beams in a direction which is directly oriented to the listening position increases. In this case, by the sound which is directly oriented to the listening position from the apparatus, there is a concern that the sound field expression related to the height channel is damaged.

In consideration of the above-described problems, the present invention is to provide a speaker array apparatus which can output a sound beam by a speaker array including a plurality of speakers, and which can reduce the sound pressure to a front side of the apparatus while increasing the sound pressure to the ceiling surface side.

A first aspect of the present invention provides a speaker array apparatus including: an apparatus housing having a disposition plane; and a speaker array which includes a plurality of speakers disposed at least in a vertical direction on the disposition plane of the apparatus housing that is opposite to a listening position, wherein the speaker array apparatus receives and distributes a sound signal input from an outside to all of or a part of the speakers of the speaker array, and outputs the distributed sound signal as a sound beam by controlling an output timing of each sound output from the all or part of the speakers, and each speaker of the speaker array has an appropriate output direction in an elevation angle, the appropriate output direction indicating a direction having a highest sound pressure in a sound pressure distribution when the sound is output from the speaker.

The speaker array apparatus includes an apparatus housing, and a speaker array which includes a plurality of speakers disposed at least in a vertical direction on a disposition plane of the apparatus housing, a sound signal input from the outside can be distributed to all of or a part of the speakers of the speaker array, and a sound beam which is oriented to the listening position from an upper position can be output by controlling an output timing of the sound output from the speakers. The speakers of the speaker array generally exhibit high sound pressure in an appropriate output direction, and exhibit lower sound pressure in a direction (that is, an orientation horizontal to the disposition plane) of diverging from the appropriate output direction. Therefore, according to the speaker array apparatus, in order to dispose the speakers which configure the speaker array on the disposition plane in the apparatus housing so that the appropriate output direction makes the elevation angle (that is, an upward angle with respect to the horizontal direction), when the sound beam is output, it is possible to increase the sound pressure to the ceiling surface side, to reduce the sound pressure to the apparatus front side, and thereby to enhance the quality of the sound field expression by the height channel.

A second aspect of the present invention provides a speaker array apparatus according to the first aspect, wherein a lower-positioned speaker of the speaker array has the appropriate output direction in an elevation angle larger than a higher-positioned speaker of the speaker array.

According to the speaker array apparatus, since the speakers are disposed on the disposition plane in the apparatus housing in order to make an elevation angle larger in a lower part of the speaker array than the upper part, when the sound beam related to the height channel is output, it is possible to increase the sound pressure to the ceiling surface side, and to reduce the sound pressure to the apparatus front side for the entire speaker array, thereby enhancing the quality of the sound field expression by the height channel.

A third aspect of the present invention provides a speaker array apparatus according to the first or second aspect, wherein the disposition plane of the apparatus housing is inclined to be farther from the listening position at an upper part of the disposition plane than at a lower part of the disposition plane.

According to the speaker array apparatus, since the disposition plane of the apparatus housing is inclined to be farther from the listening position at an upper part of the disposition plane than at a lower part of the disposition plane, by disposing each speaker of the speaker array on the disposition plane, it is possible to be in a state where the appropriate output direction makes the elevation angle. In addition, when the sound beam related to the height channel is output, it is possible to increase the sound pressure to the ceiling surface side, and to reduce the sound pressure to the apparatus front side for the entire speaker array.

A fourth aspect of the present invention provides a speaker array apparatus according to the first or second aspect, wherein the disposition plane of the apparatus housing is curved to be farther from the listening position at an upper part of the disposition plane than at a lower part of the disposition plane.

According to the speaker array apparatus, since the disposition plane of the apparatus housing is curved to be farther from the listening position at the upper part of the disposition plane than at the lower part of the disposition plane, by disposing each speaker of the speaker array on the disposition plane, it is possible to be in a state where the appropriate output direction makes the elevation angle. In addition, when the sound beam related to the height channel is output, it is possible to increase the sound pressure to the ceiling surface side, and to reduce the sound pressure to the apparatus front side for the entire speaker array.

A fifth aspect of the present invention provides a speaker array apparatus according to any one of the first to third aspects, further including a suppression member which suppresses a sound directly transferred to the listening position from the speakers.

According to the speaker array apparatus, since it is possible to suppress the sound directly transferred to the listening position from the speakers by disposing a suppression member, when the sound beam related to the height channel is output, it is possible to reduce the sound pressure to the apparatus front side, thereby enhancing the quality of the sound field expression by the height channel.

A sixth aspect of the present invention provides a speaker array apparatus according to the fifth aspect, wherein the suppression member is configured of a sound insulating board which protrudes from a lower part of the speaker and covers a lower portion of the speaker.

In the speaker array apparatus, since the suppression member is configured of a sound insulating board which protrudes from a lower part of the speaker and covers a lower portion of the speaker, when the sound beam related to the height channel is output, it is possible to reduce the sound pressure to the apparatus front side and to increase the sound pressure to the ceiling surface side, thereby enhancing the quality of the sound field expression by the height channel.

A seventh aspect of the present invention provides a speaker array apparatus according to the fifth aspect, wherein the suppression member includes a net portion provided nearer to the listening position side than the disposition plane on an upper side than a horizontal direction of each speaker, wherein the net portion has a higher aperture ratio than that of a portion of the suppression member in the horizontal direction of the speaker.

In the speaker array apparatus, since the suppression member includes a net portion provided nearer to the listening position side than the disposition plane on an upper side than a horizontal direction of each speaker, and the net portion has a higher aperture ratio than that of a portion of the suppression member in the horizontal direction of the speaker, when the sound beam related to the height channel is output, it is possible to reduce the sound pressure to the apparatus front side and to increase the sound pressure to the ceiling surface side, thereby enhancing the quality of the sound field expression by the height channel.

An eighth aspect of the present invention provides a speaker array apparatus according to any one of the first to seventh aspect, wherein each speaker of the speaker array is disposed at a position which is different in the horizontal direction on the disposition plane, with respect to a speaker positioned at an upper part of each speaker in the vertical direction of the speaker array.

In the speaker array apparatus, the speakers of the speaker array are disposed at a position which is different in the horizontal direction on the disposition plane, with respect to the speakers positioned at the upper part of each speaker in the vertical direction of the speaker array. When disposing the speakers of the speaker array so that the appropriate output direction makes the elevation angle, a case where the sound output from the speakers is suppressed by the speaker positioned at the upper side in the vertical direction of the speaker array, is assumed. In this regard, according to the speaker array, since the speakers of the speaker array are disposed at the position different in the horizontal direction on the disposition plane with respect to the speaker positioned at the upper part of the speaker in the vertical direction, the sound output from each speaker is not suppressed, and it is possible to further enhance the quality of the sound field expression by the height channel.

A ninth aspect of the present invention provides a speaker array apparatus according to the eighth aspect, wherein the speakers of the speaker array are disposed on the disposition plane in a zigzag arrangement in the vertical direction.

A tenth aspect of the present invention provides a speaker array apparatus according to any one of the first to ninth aspect, further including a horn provided on the disposition plane of the apparatus housing for each speaker of the speaker array.

An eleventh aspect of the present invention provides a speaker array apparatus according to the first aspect, wherein the disposition plane of the speaker array is a vertical plane.

A twelfth aspect of the present invention provides a speaker array apparatus including: an apparatus housing having a disposition plane; a speaker array which includes a plurality of speakers disposed in a zigzag arrangement in a vertical direction on the disposition plane of the apparatus housing that is opposite to a listening position; and horns provided on the disposition plane of the apparatus housing for the speakers of the speaker array, wherein the speaker array apparatus receives and distributes a sound signal input from an outside to all of or a part of the speakers of the speaker array, and outputs the distributed sound signal as a sound beam by controlling an output timing of each sound output from the all or part of the speakers, and each speaker of the speaker array has an appropriate output direction in an elevation angle and an upward angle with respect to a horizontal direction, the appropriate output direction indicating a direction having a highest sound pressure in a sound pressure distribution when the sound is output from the speaker.

According to the speaker array apparatus according to any one of the aspects of the present invention, since the speakers of the speaker array are disposed on the disposition plane in the apparatus housing so that the appropriate output direction makes the elevation angle (that is, the upward angle with respect to the horizontal direction), when the sound beam related to the height channel is output, it is possible to increase the sound pressure to the ceiling surface side and to reduce the sound pressure to the apparatus front side, thereby enhancing the quality of the sound field expression by the height channel.

DETAILED DESCRIPTION OF THE EXEMPLARY EMBODIMENTS

Hereinafter, embodiments in which a speaker array apparatus according to the present invention is employed in a speaker array apparatus 1 will be described in detail with reference to the accompanying drawings.

First Embodiment

Figure 1:
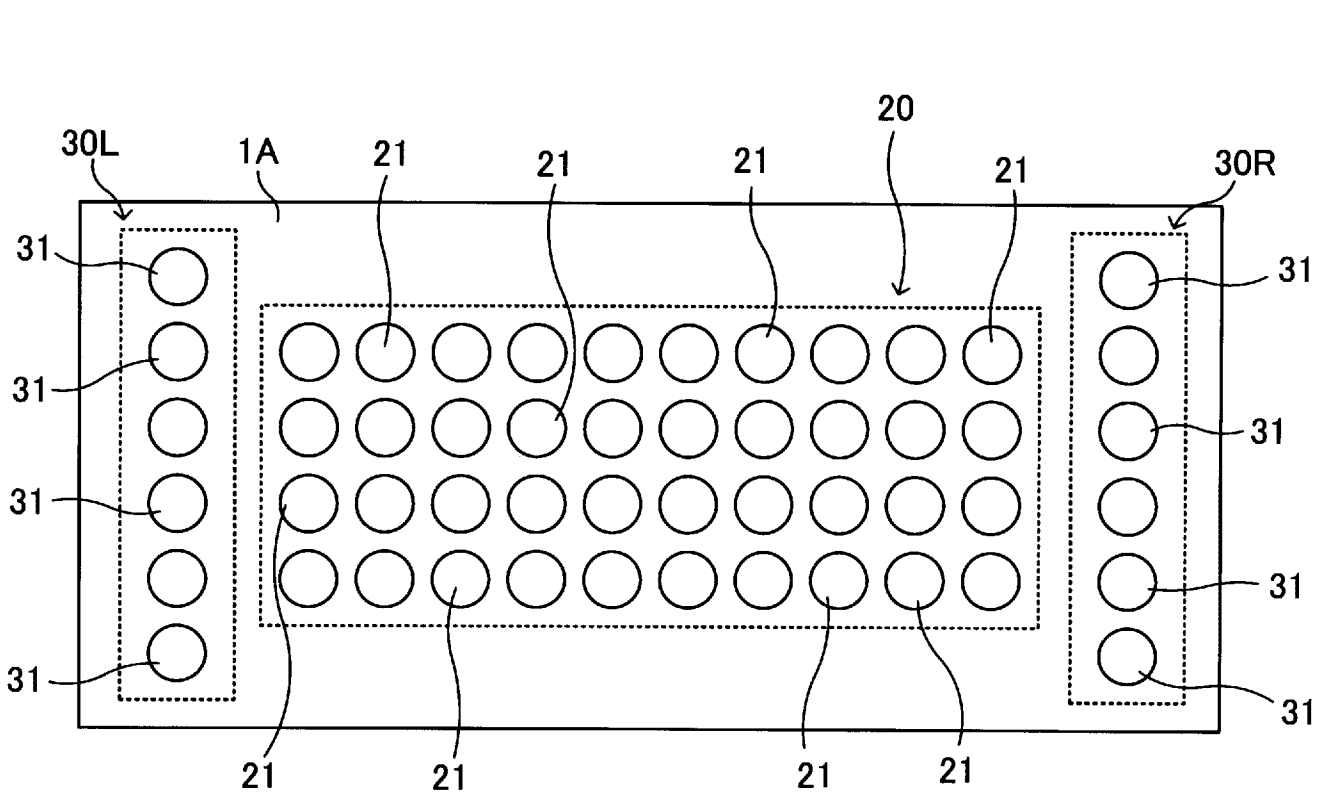
FIG. 1 is a front view of a speaker array apparatus according to a first embodiment.

First, a schematic configuration of the speaker array apparatus 1 according to a first embodiment will be described in detail with reference to FIGS. 1 to 3. As illustrated in FIG. 1, the speaker array apparatus 1 includes a speaker array unit 20 which performs sound field expression in a horizontal direction, and a height speaker array unit 30 which performs sound field expression in a height direction (vertical direction), on a front surface (a surface which opposes a listener) of an apparatus body 1A. By controlling an output direction of sound beams of each channel which configures a multi-channel, a feeling that sound from the speakers can be given to the listeners as if the speakers are disposed around the listeners.

Figure 2A:
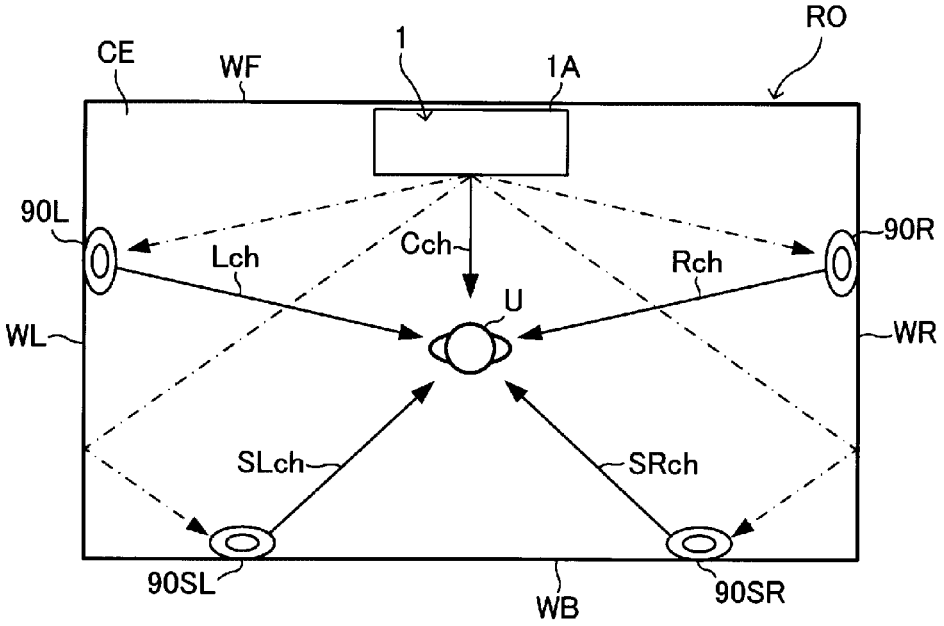
FIGS. 2A and 2B illustrate an aspect of outputting a sound beam of a multi-channel by the speaker array apparatus.

The speaker array unit 20 includes a plurality of speakers 21 which are disposed in a matrix, at the center part of the front surface of the apparatus body 1A, and outputs the sound beams of each channel, such as a center channel (Cch), a front left channel (Lch), a front right channel (Rch), a surround left channel (SLch), and a surround right channel (SRch) (refer to FIG. 2A).

As illustrated in FIG. 1, the speaker array unit 20 is configured to dispose the plurality of speakers 21 in a vertical direction and a lateral direction. The speaker array unit 20 adjusts timing of the output of the surround sound from each speaker 21 for each channel, emits the surround sound in a beam shape, and controls delay so that the sound beams are focused at an arbitrary position, such as a wall surface. In addition, by reflecting the sound of each channel to a wall of a room Ro in which the speaker array apparatus 1 is installed, a sound source (a virtual speaker 90L or the like) is made at an arbitrary point, a sound field of the multi-channel is formed, and surround sound is created (refer to FIG. 2A).

Specifically, in the speaker array apparatus 1, when an audio sound or the like is input from the outside, as illustrated in FIG. 2A, with respect to a listener U, a sound of Cch is output as a direct sound, a sound of Lch is output as a reflected sound which is reflected one time on a left wall WL, and a sound of Rch is output as a reflected sound which is reflected one time on a right wall WR. In addition, the speaker array apparatus 1 outputs a sound of SLch as a reflected sound which is reflected two times on the left wall WL and a back wall WB, and outputs a sound of SRch as a reflected sound which is reflected two times on the right wall WR and the back wall WB.

Therefore, it is possible for the listener U to enjoy ideal surround sound since the listener U can hear Cch output from the speaker array apparatus 1 positioned at a front part of the listening position, Lch from the virtual speaker 90L positioned at a left front part of the listening position, SLch from a virtual speaker 90SL positioned at a left back part of the listening position, SRch from a virtual speaker 90SR positioned at a right back part of the listening position, and Rch from a virtual speaker 90R positioned at a right front part of the listening position.

In addition, the height speaker array unit 30 includes a plurality of speakers 31 which are disposed in a line and which respectively extend in the vertical direction in both left and right end portions on the front surface of the apparatus body 1A, and outputs the sound beam (hereinafter, referred to as a height sound beam SH) related to a height left channel (HLch) and a height R channel (HRch). In the description below, the height speaker array unit 30 which is positioned in the left end portion on the front surface of the apparatus body 1A and outputs the sound beam related to HLch is called a "height speaker array unit 30L", and the height speaker array unit 30 which is positioned in the right end portion on the front surface of the apparatus body 1A and outputs the sound beam related to HRch is called a "height speaker array unit 30R". Both the height speaker array unit 30L and the height speaker array unit 30R are generally called the "height speaker array unit 30". A specific configuration of the height speaker array unit 30 will be described with reference to the drawings later.

The height speaker array unit 30 adjusts the timing of the output of the surround sound from each speaker 31 for each channel, emits the surround sound in a beam shape, and controls delay so that the sound beams are focused at an arbitrary position in a ceiling CE. In addition, by reflecting the sound of each channel to the ceiling CE of the room Ro in which the speaker array apparatus 1 is installed, a sound source (a virtual speaker 90HL and a virtual speaker 90HR) is made at an arbitrary point of the ceiling CE, expression in the height or the depth direction is added to the sound field of the multi-channel, and the surround sound is created (refer to FIG. 2B).

(Configuration of Each Speaker 31 in Height Speaker Array Unit 30)

Figure 3:
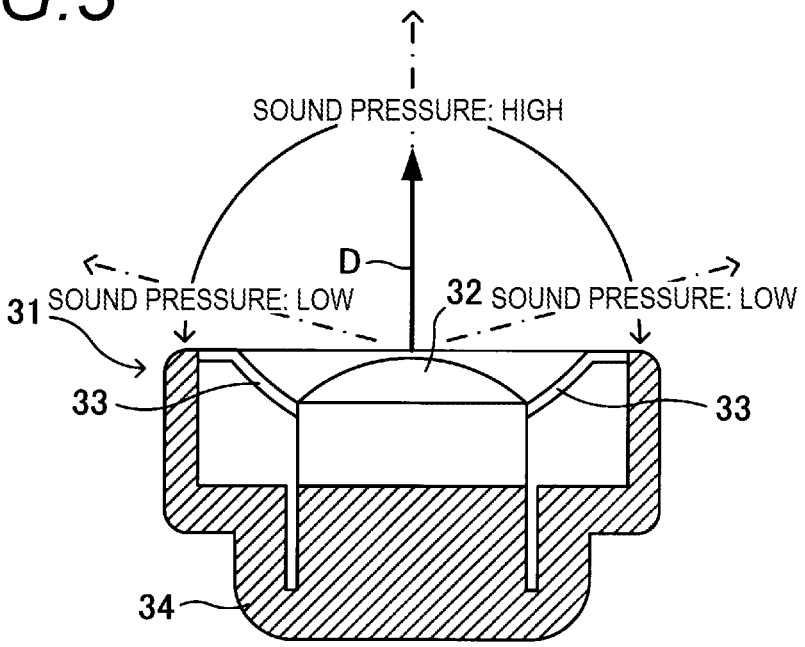
FIG. 3 illustrates a sound pressure distribution of speakers which configure a speaker array apparatus.

The speakers 31 which configure the height speaker array unit 30 are general dynamic speakers, and include a center cap 32, a diaphragm 33, a voice coil, a magnetic, and the like, inside a frame 34 (refer to FIG. 3). The speakers 31 are configured to output the sound by generating a magnetic field by making a current which corresponds to an audible sound signal with respect to the voice coil, and by oscillating the diaphragm 33 together with the voice coil by a repulsive force and an attractive force between the speaker 31 and the magnet.

In the vicinity of the center line of the speaker 31, the sound pressure distribution of the speaker 31 illustrates the highest sound pressure in a direction which is perpendicular to a front surface of the speaker 31, and illustrates a tendency that the sound pressure decreases when parallel to the direction which is horizontal to the front surface of the speaker 31. In the embodiment, in the sound pressure distribution of the speakers 31, a direction which illustrates the highest sound pressure (that is, the direction which is perpendicular to the front surface of the speaker 31) is called an appropriate output direction D.

The sound pressure distribution in a case where the plurality of speakers 31 are disposed configuring the height speaker array unit 30, with respect to the plane-like disposition plane, will be described with reference to FIG. 4. In the case illustrated in FIG. 4, each speaker 31 is disposed so that each appropriate output direction D becomes perpendicular to the disposition plane.

As illustrated in FIG. 3, since the direction which is perpendicular to the disposition plane is the appropriate output direction D, the sound pressure distribution of each speaker 31 illustrates high sound pressure, and there is a tendency for the sound pressure to decrease as going in the direction which is horizontal to the disposition plane. Therefore, in the height speaker array unit 30 in this case, the sound pressure with respect to the direction which is perpendicular to the disposition plane increases, and the sound pressure decreases as going in the direction which is horizontal to the disposition plane (refer to FIG. 4). Accordingly, in the height speaker array unit 30, it is assumed that the sound pressure of the sound beam output in the direction of making the predetermined elevation angle (one direction which is close to the horizontal direction with respect to the disposition plane) is not sufficient, and sufficient directivity cannot be ensured. In other words, in the height speaker array unit 30 illustrated in FIG. 4, a case where the sound field expression cannot be sufficiently performed by the sound beam related to the height channel, can be generated.

Figure 4:
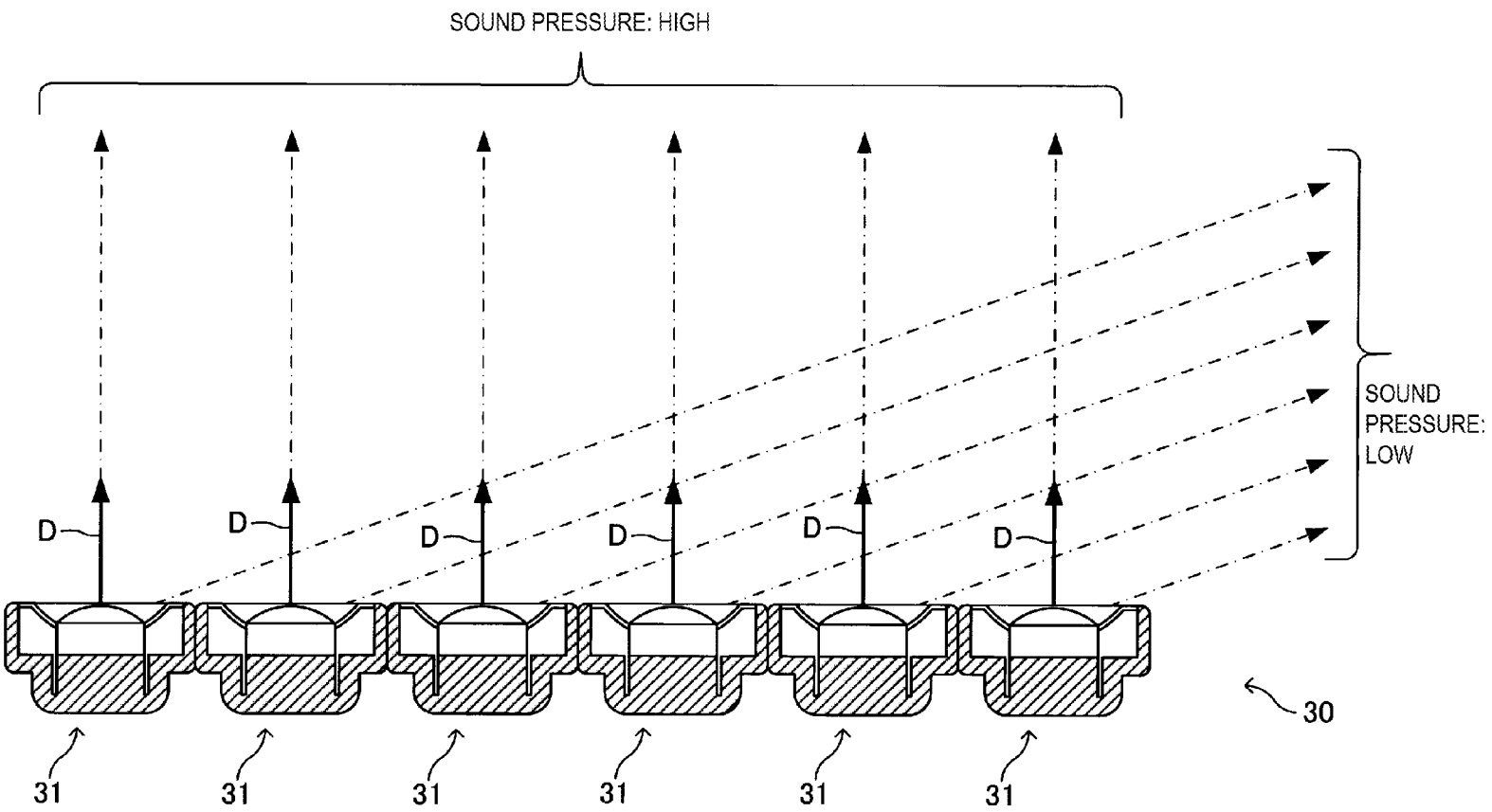
FIG. 4 illustrates a sound pressure distribution in a height speaker array unit in the related art.

In a case illustrated in FIG. 4, since the direction of facing the disposition plane (that is, the direction which is perpendicular to the disposition direction) corresponds to the appropriate output direction D, the height speaker array unit 30 outputs the sound beam having high sound pressure. Meanwhile, the sound pressure of the sound beam output in the direction of making the predetermined elevation angle becomes smaller, according to the sound pressure distribution (refer to FIG. 3) of each speaker 31. In a case of the configuration in this aspect, in the height speaker array unit 30, there is a concern that imbalance between the sound pressure of the sound beam in the direction which is directly oriented to the listening position (that is, the appropriate output direction D) and the sound pressure of the sound beam related to the height channel is generated, and the sound field expression related to the height channel is suppressed. In this regard, the speaker array apparatus 1 according to the first embodiment is configured to be capable of performing sufficient sound field expression by the sound beam related to the height channel.

(Control System of Speaker Array Apparatus 1)

Figure 5:
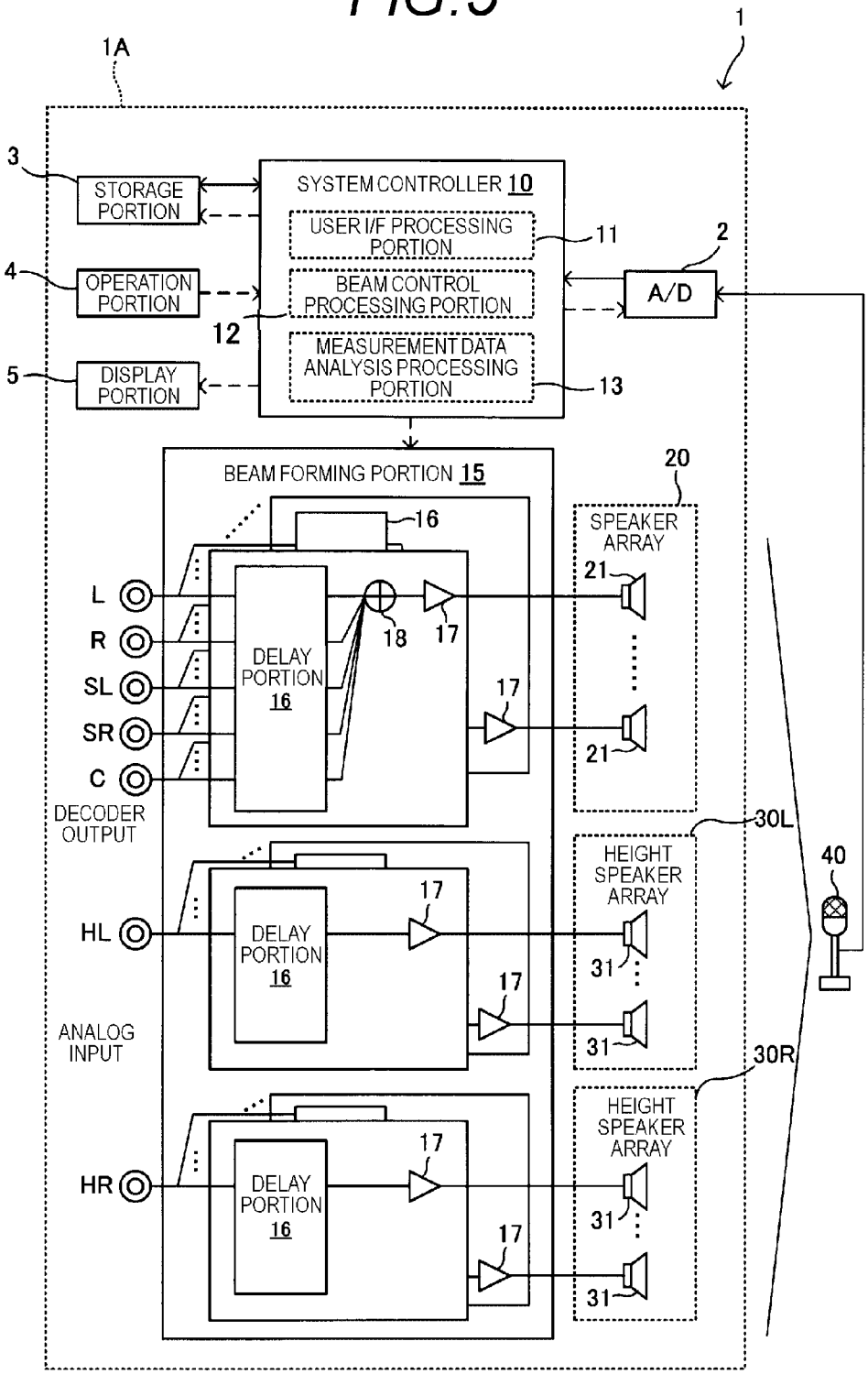
FIG. 5 is a block diagram illustrating a control system of the speaker array apparatus.

Next, a configuration of a control system of the speaker array apparatus 1 will be described in detail with reference to FIG. 5. As illustrated in FIG. 5, the speaker array apparatus 1 includes an A/D converter 2, a storage portion 3, an operation portion 4, a display portion 5, a system controller 10, a beam forming portion 15, the speaker array unit 20, and the height speaker array unit 30, in the apparatus body 1A, and also includes a microphone 40. In addition, the speaker array apparatus 1 is provided with an Lch terminal, a Rch terminal, an SLch terminal, an SRch terminal, a Cch terminal, an HLch terminal, and HRch terminal, as external input terminals of a surround sound signal related to the multi-channel.

The microphone 40 is a nondirectional microphone, and is connected to the A/D converter 2. The microphone 40 is provided for sound-collecting a test sound signal output from the speaker array unit 20 and the height speaker array unit 30 when the output direction of the sound beam is set by the speaker array unit 20 and the height speaker array unit 30.

The A/D converter 2 converts (samples) an analog sound signal collected by the microphone 40 to a digital sound signal, and outputs the signal to the system controller 10.

The storage portion 3 stores the digital sound signal output via the system controller 10 from the A/D converter 2. Specifically, the storage portion 3 stores the digital sound signal which is collected by the microphone 40 and output via the A/D converter 2 and the system controller 10, in correlation with an output angle of the sound beam.

When installing the speaker array apparatus 1, or the like, the operation portion 4 receives various setting inputs from the listener U, and outputs the signal which corresponds to the input to the system controller 10.

Based on a control signal output from the system controller 10, the display portion 5 displays the contents related to the control signal, and transfers the contents to the listener U.

The system controller 10 includes a user I/F processing portion 11, a beam control processing portion 12, and a measurement data analysis processing portion 13.

The user I/F processing portion 11 outputs the control signal to each portion of the speaker array apparatus 1 in accordance with the receiving operation in the operation portion 4. In addition, the user I/F processing portion 11 displays the contents to be notified to the listener U on the display portion 5 in accordance with the situation of the speaker array apparatus 1.

When performing a sound beam setting mode which sets an angle of the output of the sound beam of each channel, for example, when installing the speaker array apparatus 1, the beam control processing portion 12 outputs the test sound signal to the beam forming portion 15, and sweeps (turns) the sound beam of the test sound output from the speaker array unit 20.

The measurement data analysis processing portion 13 stores the test sound signal which is output from the speaker array unit 20 and collected by the microphone 40 in the storage portion 3 when performing the sound beam setting mode. In addition, when collection of the sound signal is completed, the measurement data analysis processing portion 13 reads the sound signal stored in the storage portion 3, detects peaks of the sound signal, sets the output angle of the sound of each channel that configures the multi-channel based on each peak, and outputs the result to the beam control processing portion 12.

The beam control processing portion 12 outputs an angle setting signal for performing the angle setting of each channel to the beam forming portion 15 based on an analysis result output from the measurement data analysis processing portion 13.

The beam forming portion 15 has a block which includes a delay portion 16 and a power amplifier 17, in each speaker 21 which configures the speaker array unit 20, and in each speaker 31 which configures the height speaker array unit 30L and the height speaker array unit 30R. The block with respect to each speaker 21 of the speaker array unit 20 includes the delay portion 16 which performs deferred processing with respect to each of the sound signals related to each channel of Lch, Rch, SLch, SRch, and Cch, an adder 18 which adds the sound signals of each channel output from the delay portion 16, and the power amplifier 17 which amplifies the signal output from the adder 18 for forming the sound beam. Each of the speakers 21 is connected to the output of each block.

The block with respect to each speaker 31 of the height speaker array unit 30L includes the delay portion 16 which performs deferred processing with respect to the sound signal related to HLch, and the power amplifier 17 which amplifies the signal output from the delay portion 16 for forming the height sound beam SH related to HLch. In addition, the block with respect to each speaker 31 of the height speaker array unit 30R includes the delay portion 16 which performs deferred processing with respect to the sound signal related to HRch, and the power amplifier 17 which amplifies the signal output from the delay portion 16 for forming the height sound beam SH related to HRch. Each of the speakers 31 is connected to the output of each block related to the height speaker array unit 30R and the height speaker array unit 30L.

The beam forming portion 15 forms the sound beam of each channel based on the angle setting signals of each channel output from the system controller 10, and outputs the sound signal to the speaker array unit 20 and the height speaker array unit 30. In addition, when the test signal is output from the system controller 10, the beam forming portion 15 processes the sound signal to sweep the sound beam output from the speaker array unit 20 and the height speaker array unit 30, and outputs the sound signal to the speaker array unit 20 and the height speaker array unit 30.

Based on the sound signal output from the beam forming portion 15, the speaker array unit 20 outputs the sound beams of each channel of Lch, Rch, SLch, SRch, and Cch, which configure the multi-channel.

Based on the sound signal output from the beam forming portion 15, the height speaker array unit 30 outputs the sound beams of each channel of HLch and HRch, which configure the multi-channel. Specifically, the height speaker array unit 30L outputs the sound beam of HLch based on the sound signal output from the beam forming portion 15, and the height speaker array unit 30R outputs the sound beam of HRch based on the sound signal output from the beam forming portion 15.

Furthermore, when setting the output angle of the sound beam, in a case where the measurement accuracy is improved, the system controller 10 sweeps the test sound beam plural times, and controls each portion of the speaker array apparatus 1 to perform integrating and averaging processing of the sound signal.

(Specific Configuration of Height Speaker Array Unit 30 According to First Embodiment)

Figure 6A:
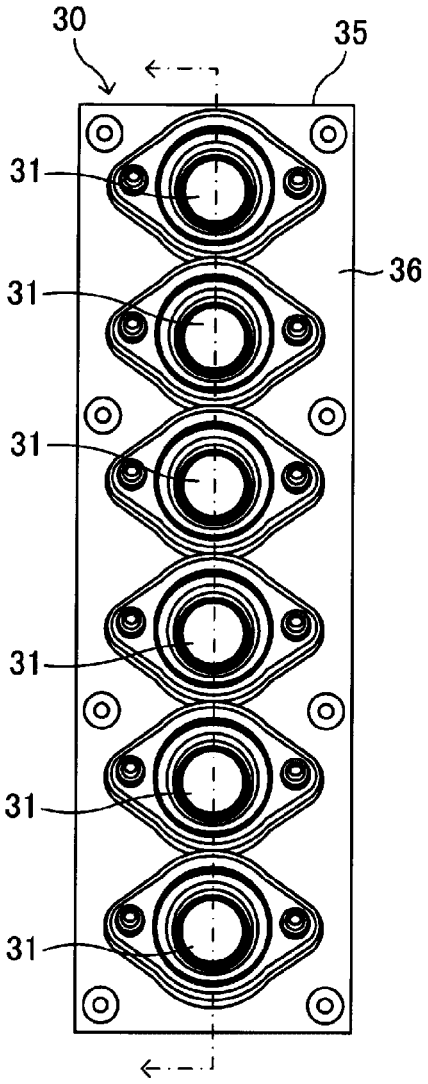
FIGS. 6A and 6B illustrate a height speaker array unit according to the first embodiment.
Figure 6B:
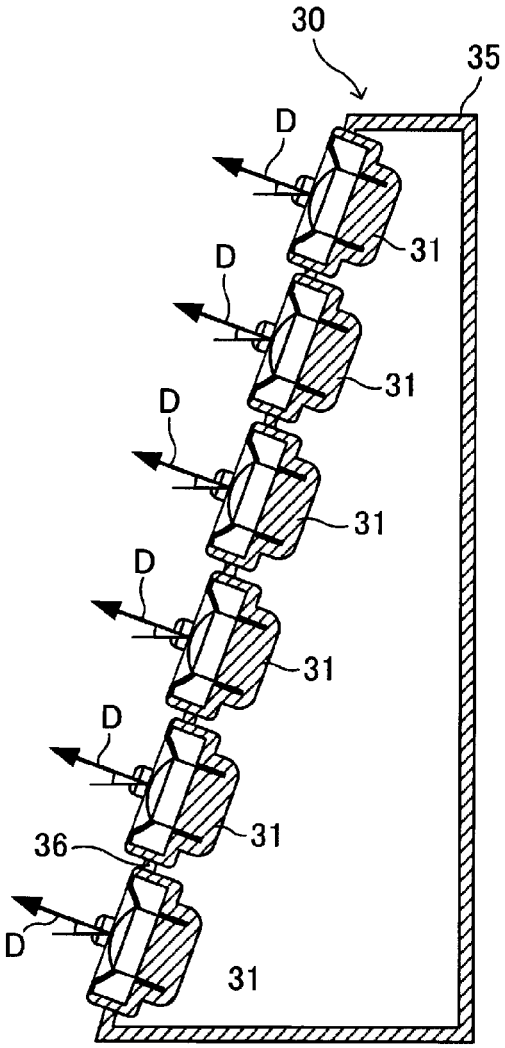

Next, a specific configuration of the height speaker array unit 30 according to the first embodiment will be described in detail with reference to the drawings. FIGS. 6A and 6B illustrate the configuration of the height speaker array unit 30 according to the first embodiment. FIG. 6A is a front view and FIG. 6B is a side sectional view.

Furthermore, in the following description, in the relationship illustrated in the drawings, a part of the apparatus body 1A of the speaker array apparatus 1 is omitted. A cabinet 35 is a part in the apparatus body 1A which serves as a housing of the speaker array apparatus 1, and a disposition plane 36 configures a part on the front surface (a surface which faces the listening position (listener U)) of the apparatus body 1A.

As illustrated in FIG. 6A, the height speaker array unit 30 according to the first embodiment includes six speakers 31 disposed to extend in a straight line in a vertical direction on the disposition plane 36 of the cabinet 35.

In addition, the disposition plane 36 of the cabinet 35 is inclined to be positioned on a back side of the speaker array apparatus 1 to the upper part from the lower part (that is, to be farther from the listening position in the upper part than the lower part). In addition, in the height speaker array unit 30 according to the first embodiment, each speaker 31 is fixed to maintain the predetermined angle with respect to the inclined disposition plane 36. Therefore, as illustrated in FIG. 6B, each speaker 31 which configures the height speaker array unit 30 is disposed on the disposition plane 36 of the cabinet 35 so that the appropriate output direction D makes the elevation angle (that is, the upward angle with respect to the horizontal direction).

Accordingly, in the speaker array apparatus 1 according to the first embodiment, since each speaker 31 of the height speaker array unit 30 is disposed on the disposition plane 36 which is inclined to be farther from the listening position in the upper part than the lower part so that the appropriate output direction D makes the elevation angle, it is possible to increase the sound pressure of the sound beam which is oriented to the ceiling CE side.

In addition, when the speakers 31 are disposed as illustrated in FIG. 6B, the horizontal direction on the listening position side corresponds to the direction in which the sound pressure is smaller than that in the appropriate output direction D as also can be ascertained from the sound pressure distribution of the speakers 31 illustrated in FIG. 3. Therefore, in the speaker array apparatus 1 according to the first embodiment, it is possible to reduce the sound pressure in the direction toward the listening position (horizontal direction) from the height speaker array unit 30.

As described above, the speaker array apparatus 1 according to the first embodiment includes the height speaker array unit 30, distributes the sound signal input from the outside to the plurality of speakers 31 that configure the height speaker array unit 30, and controls the output timing of the sound output from the speaker. Accordingly, it is possible to output the sound beam of the height channel toward the listening position from an upper position (refer to FIG. 2B).

As illustrated in FIG. 3, the speakers 31 which configure the height speaker array unit 30 exhibit high sound pressure in the appropriate output direction D, and there is a tendency for the sound pressure to decrease when approaching in the direction of diverging from the appropriate output direction D (that is, an orientation which is horizontal to the disposition plane). Therefore, according to the speaker array apparatus 1, as illustrated in FIG. 6B, since the speakers 31 which configure the height speaker array unit 30 are disposed on the disposition plane 36 of the cabinet 35 so that the appropriate output direction D makes the elevation angle (that is, the upward angle with respect to the horizontal direction), when the sound beam related to the height channel is output, it is possible to increase the sound pressure to the ceiling CE side, and to reduce the sound pressure at the listening position on the apparatus front side. In other words, according to the speaker array apparatus 1, it is possible to keep balance between the sound pressure of the sound beam related to the height channel which is oriented to the ceiling CE side, and the sound pressure of the sound beam to the apparatus front side, and to enhance the quality of the sound field expression by the height channel.

In addition, in the speaker array apparatus 1 according to the first embodiment, since the disposition plane 36 of the cabinet 35 is inclined to be farther from the listening position to the upper part from the lower part of the disposition plane 36, by disposing each speaker 31 of the height speaker array unit 30 on the disposition plane 36, it is possible to be in a state where the appropriate output direction D makes the elevation angle, and when the sound beam related to the height channel is output, as the entire speaker array, it is possible to increase the sound pressure to the ceiling CE side, and to reduce the sound pressure to the apparatus front side. In other words, according to the speaker array apparatus 1, it is possible to keep balance between the sound pressure of the sound beam related to the height channel which is oriented to the ceiling CE side, and the sound pressure of the sound beam to the apparatus front side, and further, to perform the sound field expression by the height channel while suppressing the influence of the sound beam caused by the sound beam to the apparatus front side.

Second Embodiment

Next, an embodiment (second embodiment) which is different from the above-described first embodiment will be described in detail with reference to FIGS. 7A and 7B. The speaker array apparatus 1 according to the second embodiment has a basic configuration which is substantially the same as that of the speaker array apparatus 1 according to the first embodiment, and has a different configuration of the height speaker array unit 30. Regarding the configuration which is the same as that of the first embodiment, the description thereof will be omitted, and the configuration related to the difference will be described in detail.

(Specific Configuration of Height Speaker Array Unit 30 According to Second Embodiment)

Next, a specific configuration of the height speaker array unit 30 according to the second embodiment will be described in detail with reference to the drawings. FIGS. 7A and 7B illustrate the configuration of the height speaker array unit 30 according to the second embodiment. FIG. 7A is a front view, and FIG. 7B is a side sectional view.

Figure 7A:
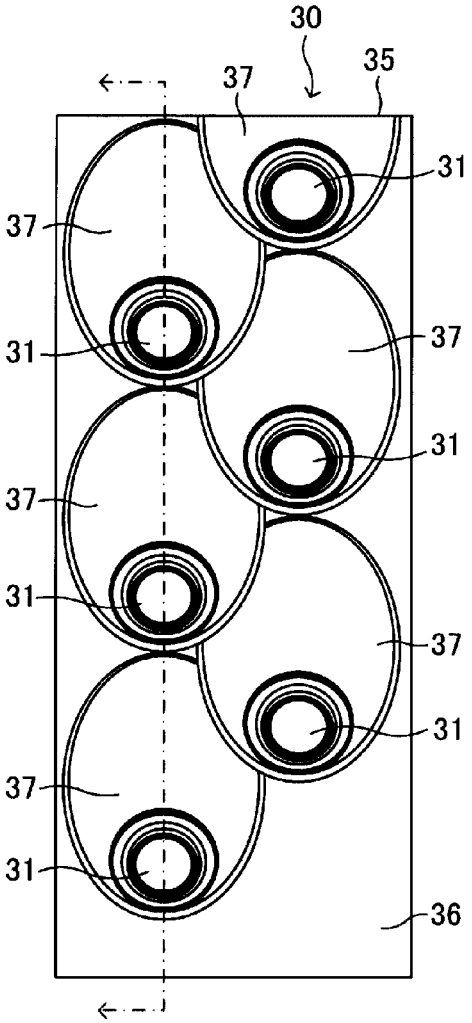
FIGS. 7A and 7B illustrate a height speaker array unit according to a second embodiment.

As illustrated in FIG. 7A, in the height speaker array unit 30 according to the second embodiment, the disposition plane 36 of the cabinet 35 extends in the vertical direction. The height speaker array unit 30 according to the second embodiment is configured so that six speakers 31 are disposed in a zigzag arrangement in the vertical direction in a front view on the disposition plane 36 of the cabinet 35. Furthermore, in this case, the height position of each speaker 31 is a position similar to the height of each speaker 31 in the first embodiment.

In addition, on the disposition plane 36 of the cabinet 35, in each speaker 31 which configures the height speaker array unit 30, a horn 37 is formed. The horn 37 is a part where the disposition plane 36 is formed in a recessed shape toward the back side of the cabinet 35, and is inclined such that each horn 37 is closer to the listening position side in the upper part than the lower part. In a lower portion of the horn 37, each of the speakers 31 is disposed so that the appropriate output direction D makes the elevation angle (refer to FIG. 7B)

Here, a case where the plurality of speakers 31 are disposed on a straight line in the vertical direction, and are respectively attached so that the appropriate output direction D makes the elevation angle on the disposition plane 36 which extends in the vertical direction, is considered. In such disposition, a case where a sound wave from a certain speaker 31 of the height speaker array unit 30 is interfered by the presence of the speakers 31 which are positioned immediately above the speaker, and the output of the sound beam in a direction in which the sound pressure relatively increases is damaged, is considered.

In this regard, in the height speaker array unit 30 according to the second embodiment, by disposing each speaker 31 in a zigzag arrangement on the disposition plane 36 in a front view, and by forming each of the horns 37, it is possible to avoid the interference by the presence of the speakers 31 positioned at the upper part. As illustrated in FIG. 7B, each speaker 31 which configures the height speaker array unit 30 is disposed in lower portions of each horn 37 on the disposition plane 36 so that the appropriate output direction D makes the elevation angle (that is, the upward angle with respect to the horizontal direction). Therefore, according to the height speaker array unit 30, while avoiding the interference of the sound wave, it is possible to increase the sound pressure to the ceiling CE side, and to reduce the sound pressure to the apparatus front side.

Figure 7B:
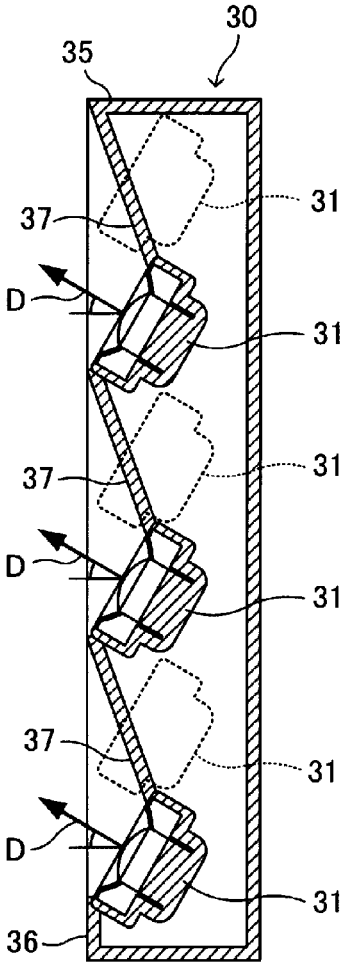

In addition, in a case of the disposition illustrated in FIG. 7B, the horizontal direction on the listening position side corresponds to the direction in which the sound pressure is smaller than that in the appropriate output direction D as can be ascertained from the sound pressure distribution of the speakers 31 illustrated in FIG. 3. Therefore, in the speaker array apparatus 1 according to the second embodiment, it is possible to reduce the sound pressure in the direction (horizontal direction) toward the listening position from the height speaker array unit 30.

Figure 2B:
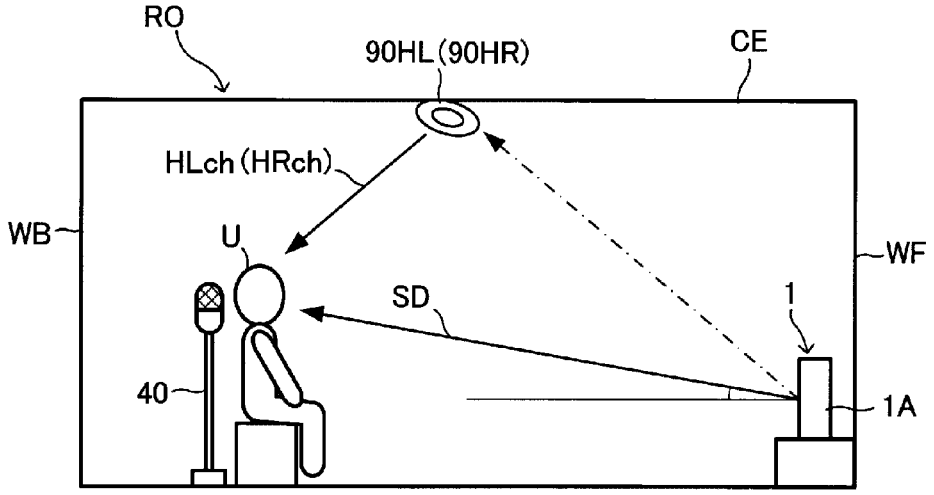

As described above, similar to the speaker array apparatus 1 according to the first embodiment, the speaker array apparatus 1 according to the second embodiment includes the height speaker array unit 30, and the sound signal input from the outside is distributed to the plurality of speakers 31 which configure the height speaker array unit 30, and by controlling the output timing of the sound output from the speaker, it is possible to output the sound beam of the height channel which is oriented to the listening position from the upper position (refer to FIG. 2B).

According to the height speaker array unit 30 according to the second embodiment, as illustrated in FIG. 7B, since the speakers 31 which configure the height speaker array unit 30 are disposed on the disposition plane 36 of the cabinet 35 so that the appropriate output direction D makes the elevation angle (that is, the upward angle with respect to the horizontal direction), when the sound beam related to the height channel is output, it is possible to increase the sound pressure to the ceiling CE side, to reduce the sound pressure to the listening position on the apparatus front side, and further, to enhance the quality of the sound field expression by the height channel.

As illustrated in FIG. 7A, the speakers 31 of the height speaker array unit 30 are disposed in a zigzag arrangement in a front view on the disposition plane 36. In other words, a certain speaker 31 of the height speaker array unit 30 is disposed at a position different in the horizontal direction on the disposition plane 36 with respect to the speakers 31 positioned at the upper part in the vertical direction. Accordingly, since it is possible to avoid the interference by the speakers positioned at the upper part, the speaker array apparatus 1 according to the second embodiment can further enhance the quality of the sound field expression by the height channel. In addition, by disposing each speaker 31 of the height speaker array unit 30 as illustrated in FIG. 7A, since it is possible to narrow the pitch of the speakers 31 related to the vertical direction, according to the speaker array apparatus 1, it is possible to ensure the directivity in a high frequency zone regarding the sound output from the height speaker array unit 30.

Third Embodiment

Next, an embodiment (third embodiment) which is different from the above-described embodiments will be described in detail with reference to FIGS. 8A and 8B. The speaker array apparatus 1 according to the third embodiment has a basic configuration which is substantially the same as that of the speaker array apparatus 1 according to each of the above-described embodiments, and has a different configuration of the height speaker array unit 30. Regarding the configuration which is the same as those of the above-described embodiments, the description thereof will be omitted, and the configuration related to the difference will be described in detail.

(Specific Configuration of Height Speaker Array Unit 30 According to Third Embodiment)

Next, a specific configuration of the height speaker array unit 30 according to the third embodiment will be described in detail with reference to the accompanying drawings. FIGS. 8A and 8B illustrate the configuration of the height speaker array unit 30 according to the third embodiment. FIG. 8A is a front view, and FIG. 8B is a side sectional view.

Figure 8A:
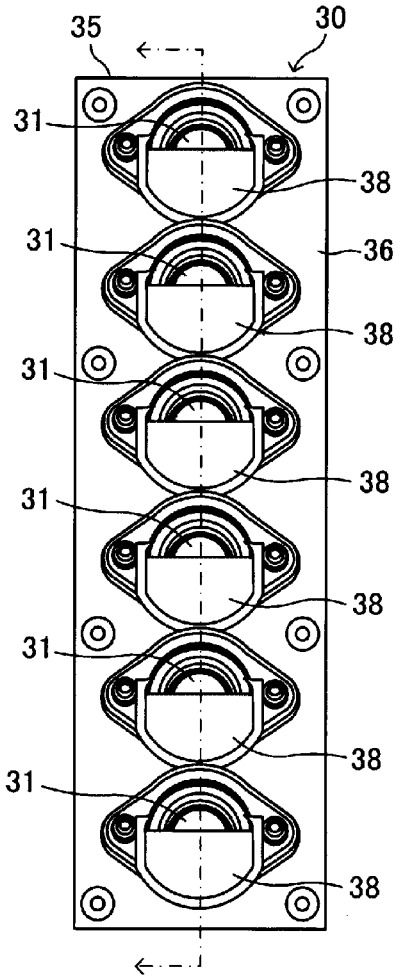
FIGS. 8A and 8B illustrate a height speaker array unit according to a third embodiment.
Figure 8B:
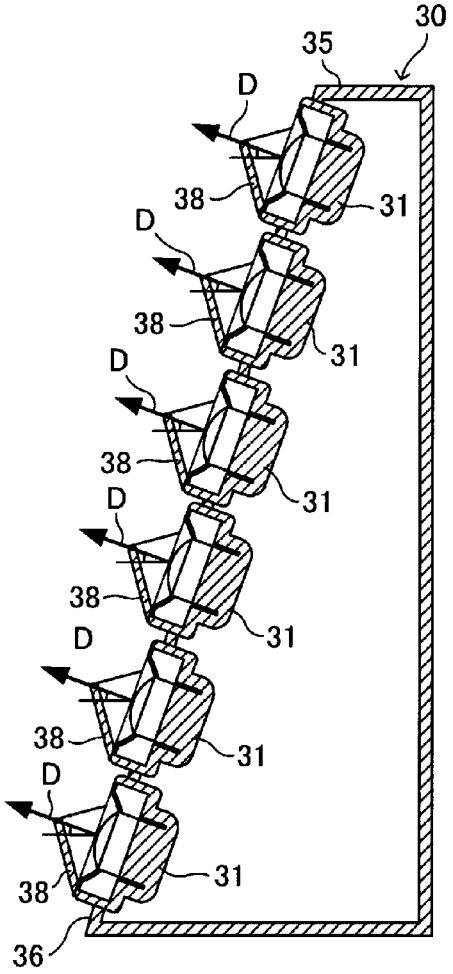

As illustrated in FIGS. 8A and 8B, similar to the first embodiment, the height speaker array unit 30 according to the third embodiment is configured to dispose six speakers 31 to extend in a straight line in the vertical direction on the disposition plane 36 of the cabinet 35, and the disposition plane 36 of the cabinet 35 is inclined to be positioned on the back side of the speaker array apparatus 1 in the upper part (that is, to be farther from the listening position in the upper part than the lower part).

In addition, in the height speaker array unit 30 according to the third embodiment, each speaker 31 is fixed to make the predetermined angle on the inclined disposition plane 36. Therefore, as illustrated in FIG. 8B, each speaker 31 which configures the height speaker array unit 30 is disposed on the disposition plane 36 of the cabinet 35 so that the appropriate output direction D makes the elevation angle (that is, the upward angle with respect to the horizontal direction).

Accordingly, in the speaker array apparatus 1 according to the third embodiment, since each speaker 31 of the height speaker array unit 30 is disposed on the disposition plane 36 which is inclined to be farther from the listening position in the upper part than the lower part so that the appropriate output direction D makes the elevation angle, it is possible to increase the sound pressure of the sound beam which is oriented to the ceiling CE side.

In addition, in the third embodiment, sound insulating board members 38 which serve as suppression members are disposed in each speaker 31 of the height speaker array unit 30 (refer to FIG. 8B). Each sound insulating board member 38 is a board-shaped member which is disposed to protrude from the lower part of the speaker 31 and to cover the lower portion of the speaker 31, and suppresses the sound which is directly transferred to the listening position from the speakers 31. Accordingly, according to the speaker array apparatus 1, since it is possible to reduce the sound pressure in the direction (horizontal direction) toward the listening position where effectiveness regarding the sound beam of the height channel is low, the sound beam related to the height channel can be efficiently used.

As described above, similar to the speaker array apparatus 1 according to the above-described embodiments, the speaker array apparatus 1 according to the third embodiment includes the height speaker array unit 30, distributes the sound signal input from the outside to the plurality of speakers 31 that configure the height speaker array unit 30, and controls the output timing of the sound output from the speaker. Accordingly, it is possible to output the sound beam of the height channel which is oriented to the listening position from the upper position (refer to FIG. 2B).

According to the speaker array apparatus 1 according to the third embodiment, as illustrated in FIG. 8B, since the speakers 31 which configure the height speaker array unit 30 are disposed on the disposition plane 36 of the cabinet 35 so that the appropriate output direction D makes the elevation angle (that is, the upward angle with respect to the horizontal direction), and each speaker 31 exhibits the sound pressure distribution illustrated in FIG. 3, when the sound beam related to the height channel is output, it is possible to increase the sound pressure to the ceiling CE side, to reduce the sound pressure to the listening position on the apparatus front side, and further, to enhance the quality of the sound field expression by the height channel.

In addition, in the speaker array apparatus 1 according to the third embodiment, since the disposition plane 36 of the cabinet 35 is inclined to be farther from the listening position in the upper part of the disposition plane 36 than the lower part, by disposing each speaker 31 on the disposition plane 36, it is possible to be in a state where the appropriate output direction D makes the elevation angle, and when the sound beam related to the height channel is output, it is possible to increase the sound pressure to the ceiling CE side, and to reduce the sound pressure to the apparatus front side for the entire speaker array.

In addition, as illustrated in FIG. 8B, in the speaker array apparatus 1 according to the third embodiment, with respect to each speaker 31 of the height speaker array unit 30, the sound insulating board member 38 which serves as the suppression member is a board-shaped member which is disposed to protrude from the lower part of the speaker and cover the lower portion of the speaker, and suppresses the sound which is directly transferred to the listening position from the speakers 31. Therefore, according to the speaker array apparatus 1, since it is possible to reduce the sound pressure in the direction (horizontal direction) toward the listening position where the effectiveness regarding the sound beam of the height channel is low, the sound beam related to the height channel can be efficiently used.

Fourth Embodiment

Next, an embodiment (fourth embodiment) which is different from the above-described embodiments will be described in detail with reference to FIGS. 9A and 9B. The speaker array apparatus 1 according to the fourth embodiment has a basic configuration which is substantially the same as that of the speaker array apparatus 1 according to each of the above-described embodiments, and has a different configuration of the height speaker array unit 30. Regarding the configuration which is the same as those of the above-described embodiments, the description thereof will be omitted, and the configuration related to the difference will be described in detail.

(Specific Configuration of Height Speaker Array Unit 30 According to Fourth Embodiment)

Next, a specific configuration of the height speaker array unit 30 according to the fourth embodiment will be described in detail with reference to the drawings. FIGS. 9A and 9B illustrate the configuration of the height speaker array unit 30 according to the fourth embodiment. FIG. 9A is a front view, and FIG. 9B is a side sectional view.

Figure 9A:
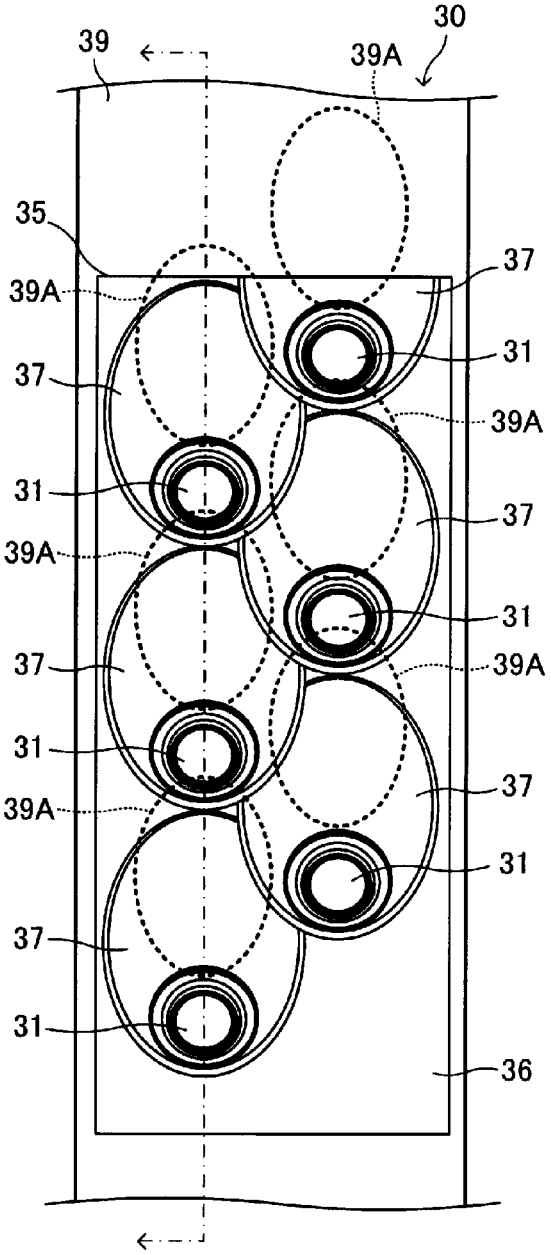
FIGS. 9A and 9B illustrate a height speaker array unit according to a fourth embodiment.
Figure 9B:
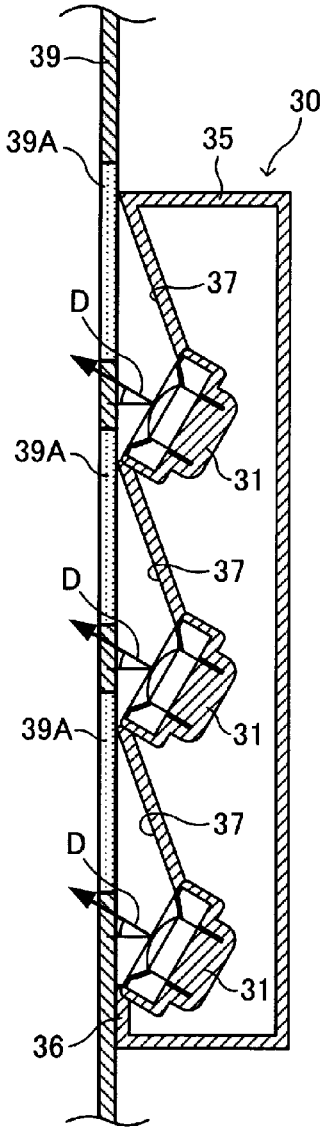

As illustrated in FIG. 9B, the disposition plane 36 of the height speaker array unit 30 according to the fourth embodiment extends in the vertical direction. As illustrated in FIG. 9A, the height speaker array unit 30 according to the fourth embodiment is configured so that six speakers 31 are disposed in a zigzag arrangement in the vertical direction in a front view on the disposition plane 36 of the cabinet 35. Furthermore, the height position of each speaker 31 in this case is a position similar to the height of each speaker 31 in the first embodiment.

In addition, on the disposition plane 36 of the cabinet 35, in each speaker 31 which configures the height speaker array unit 30, the horn 37 is formed. The horn 37 is a part where the disposition plane 36 is formed in a recessed shape toward the back side of the cabinet 35, and is inclined such that each horn 37 is closer to the listening position side in the upper part than the lower part. In the lower portion of the horn 37, each of the speakers 31 is disposed so that the appropriate output direction D makes the elevation angle (refer to FIG. 9B).

Therefore, according to the height speaker array unit 30 according to the fourth embodiment, similar to the second embodiment, by disposing each speaker 31 in a zigzag arrangement on the disposition plane 36 in a front view, and by forming each horn 37, it is possible to avoid the interference by the presence of speakers 31 positioned at the upper part. As illustrated in FIG. 9B, each speaker 31 which configures the height speaker array unit 30 is disposed in the lower portions of each horn 37 on the disposition plane 36 so that the appropriate output direction D makes the elevation angle (that is, the upward angle with respect to the horizontal direction). Therefore, according to the height speaker array unit 30, while avoiding the interference of the sound wave, it is possible to increase the sound pressure to the ceiling CE side, and to reduce the sound pressure to the apparatus front side.

In addition, when the speakers 31 is disposed as illustrated in FIG. 9B, as can be ascertained from the sound pressure distribution of the speakers 31 illustrated in FIG. 3, the horizontal direction on the listening position side corresponds to the direction in which the sound pressure is smaller than that in the appropriate output direction D. Therefore, in the speaker array apparatus 1 according to the second embodiment, it is possible to reduce the sound pressure in the direction (horizontal direction) toward the listening position from the height speaker array unit 30.

Furthermore, in the fourth embodiment, a suppression member 39 is disposed on the listening position side (front side) on the disposition plane 36 of the cabinet 35, and includes a net portion 39A on an upper side than the horizontal direction of each speaker 31. Each net portion 39A is configured by forming a plurality of holes which penetrate the suppression member 39 in the predetermined region further on the upper side than the horizontal direction of each speaker 31. Each hole is disposed so that an aperture ratio increases to the upper part from the lower part. As illustrated in FIGS. 9A and 9B, since it is possible to suppress the sound which is directly transferred to the listening position from the speakers 31 by the suppression member 39, according to the speaker array apparatus 1, it is possible to reduce the sound pressure in the direction (horizontal direction) toward the listening position where the effectiveness regarding the sound beam of the height channel is low, and further, to make the sound beam related to the height channel efficiently act.

As described above, similar to the speaker array apparatus 1 according to the first embodiment, the speaker array apparatus 1 according to the fourth embodiment includes the height speaker array unit 30, distributes the sound signal input from the outside to the plurality of speakers 31 that configure the height speaker array unit 30, and controls the output timing of the sound output from the speaker. Accordingly, it is possible to output the sound beam of the height channel which is oriented to the listening position from the upper position (refer to FIG. 2B).

According to the height speaker array unit 30 according to the fourth embodiment, as illustrated in FIG. 9B, since the speakers 31 which configure the height speaker array unit 30 are disposed on the disposition plane 36 of the cabinet 35 so that the appropriate output direction D makes the elevation angle (that is, the upward angle with respect to the horizontal direction), when the sound beam related to the height channel is output, it is possible to increase the sound pressure to the ceiling CE side, to reduce the sound pressure to the listening position on the apparatus front side, and further, to enhance the quality of the sound field expression by the height channel.

As illustrated in FIG. 9A, the speakers 31 of the height speaker array unit 30 are disposed on the disposition plane 36 in a zigzag arrangement in a front view. In other words, a certain speaker 31 of the height speaker array unit 30 is disposed at a position different in the horizontal direction on the disposition plane 36, with respect to the speakers 31 positioned at the upper part in the vertical direction. Accordingly, since it is possible to avoid the interference by the speakers positioned at the upper part, the speaker array apparatus 1 according to the fourth embodiment can further enhance the quality of the sound field expression by the height channel. In addition, since it is possible to narrow the pitch of the speakers 31 related to the vertical direction, according to the speaker array apparatus 1, it is possible to ensure the directivity in a high frequency zone regarding the sound output from the height speaker array unit 30.

In addition, in the speaker array apparatus 1 according to the fourth embodiment, the suppression member 39 is disposed on the disposition plane 36 of the height speaker array unit 30, and the suppression member 39 includes the net portion 39A at a position which corresponds to each speaker 31 of the height speaker array unit 30 (refer to FIG. 9B). Therefore, according to the speaker array apparatus 1, since it is possible to reduce the sound pressure in the direction (horizontal direction) toward the listening position where the effectiveness regarding the sound beam of the height channel is low, the sound beam related to the height channel can be efficiently used.

Fifth Embodiment

Next, an embodiment (fifth embodiment) which is different from the above-described embodiments will be described in detail with reference to FIG. 10. The speaker array apparatus 1 according to the fifth embodiment has a basic configuration which is substantially the same as that of the speaker array apparatus 1 according to each of the above-described embodiments, and has a different configuration of the height speaker array unit 30. Regarding the configuration which is the same as those of the above-described embodiments, the description thereof will be omitted, and the configuration related to the difference will be described in detail.

(Specific Configuration of Height Speaker Array Unit 30 According to Fifth Embodiment)

Figure 10:
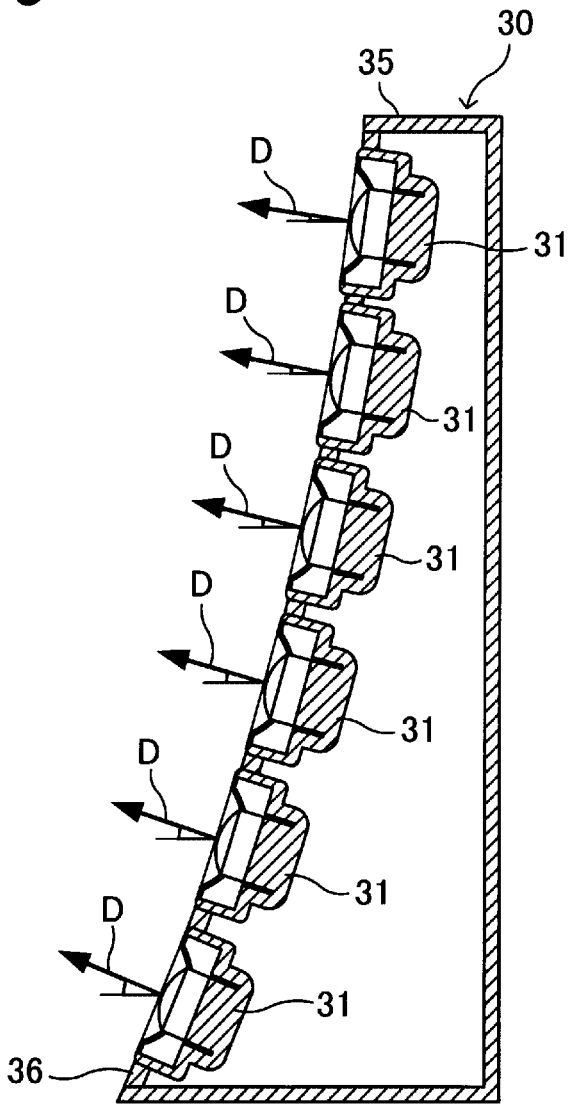
FIG. 10 illustrates a height speaker array unit according to a fifth embodiment.

As illustrated in FIG. 10, similar to the first embodiment, the height speaker array unit 30 according to the fifth embodiment is configured to dispose six speakers 31 to extend in a line in the vertical direction on the disposition plane 36 of the cabinet 35, and the disposition plane 36 of the cabinet 35 is curved to be positioned on the back side of the speaker array apparatus 1 in the upper part (that is, to be farther from the listening position in the upper part than the lower part).

In addition, in the height speaker array unit 30 according to the fifth embodiment, each speaker 31 is fixed to make the predetermined angle on the curved disposition plane 36. Therefore, as illustrated in FIG. 10, each speaker 31 which configures the height speaker array unit 30 is disposed on the disposition plane 36 of the cabinet 35 so that the appropriate output direction D makes the elevation angle (that is, the upward angle with respect to the horizontal direction). Since each speaker 31 is disposed on the curved disposition plane 36, each speaker 31 is disposed so that the elevation angle made by the appropriate output direction D of each speaker 31 increases as much as the appropriate output direction D positioned at the lower part.

Accordingly, in the speaker array apparatus 1 according to the fifth embodiment, since each speaker 31 of the height speaker array unit 30 is disposed on the curved disposition plane 36 which is curved to be farther from the listening position in the upper part than the lower part so that the appropriate output direction D makes the elevation angle, it is possible to increase the sound pressure of the sound beam which is oriented to the ceiling CE side, and to reduce the sound pressure which is oriented to the listening position side.

As described above, similar to the speaker array apparatus 1 according to the above-described embodiments, the speaker array apparatus 1 according to the fifth embodiment includes the height speaker array unit 30, distributes the sound signal input from the outside to the plurality of speakers 31 that configure the height speaker array unit 30, and controls the output timing of the sound output from the speaker. Accordingly, it is possible to output the sound beam of the height channel which is oriented to the listening position from the upper position (refer to FIG. 2B).

According to the speaker array apparatus 1 according to the fifth embodiment, as illustrated in FIG. 10, since the speakers 31 which configure the height speaker array unit 30 are disposed on the disposition plane 36 of the cabinet 35 so that the appropriate output direction D makes the elevation angle (that is, the upward angle with respect to the horizontal direction), and each speaker 31 exhibits the sound pressure distribution illustrated in FIG. 3, when the sound beam related to the height channel is output, it is possible to increase the sound pressure to the ceiling CE side, to reduce the sound pressure to the listening position on the apparatus front side, and further, to enhance the quality of the sound field expression by the height channel.

In addition, in the speaker array apparatus 1 according to the fifth embodiment, since the disposition plane 36 of the cabinet 35 is curved to be farther from the listening position in the upper part of the disposition plane 36 than the lower part, by disposing each speaker 31 on the disposition plane 36, it is possible to be in a state where the appropriate output direction D makes the elevation angle, and when the sound beam related to the height channel is output, it is possible to increase the sound pressure to the ceiling CE side, and to reduce the sound pressure to the apparatus front side for the entire speaker array.

Furthermore, according to the speaker array apparatus 1 according to the fifth embodiment, since each speaker 31 is disposed on the disposition plane 36 so that an larger elevation angle is made in the lower part of the height speaker array unit 30 than the upper part, when the sound beam related to the height channel is output, it is possible to increase the sound pressure to the ceiling CE side and to reduce the sound pressure to the apparatus front side for the entire speaker 31, and thereby enhancing the quality of the sound field expression by the height channel.

Sixth Embodiment

Next, an embodiment (sixth embodiment) which is different from the above-described embodiments will be described in detail with reference to FIG. 11. The speaker array apparatus 1 according to the sixth embodiment has a basic configuration which is substantially the same as that of the speaker array apparatus 1 according to each of the above-described embodiments, and has a different configuration of the height speaker array unit 30. Regarding the configuration which is the same as those of the above-described embodiments, the description thereof will be omitted, and the configuration related to the difference will be described in detail.

(Specific Configuration of Height Speaker Array Unit 30 According to Sixth Embodiment)

Next, a specific configuration of the height speaker array unit 30 according to the sixth embodiment will be described in detail with reference to the accompanying drawings. FIG.

11 is a side sectional view illustrating the configuration of the height speaker array unit 30 according to the sixth embodiment.

Similar to the second embodiment, on the disposition plane 36 of the cabinet 35, the height speaker array unit 30 according to the sixth embodiment is configured so that six speakers 31 are disposed in a zigzag arrangement in the vertical direction in a front view. Furthermore, in this case, the height position of each speaker 31 is a position similar to the height of each speaker 31 in the first embodiment.

Figure 11:
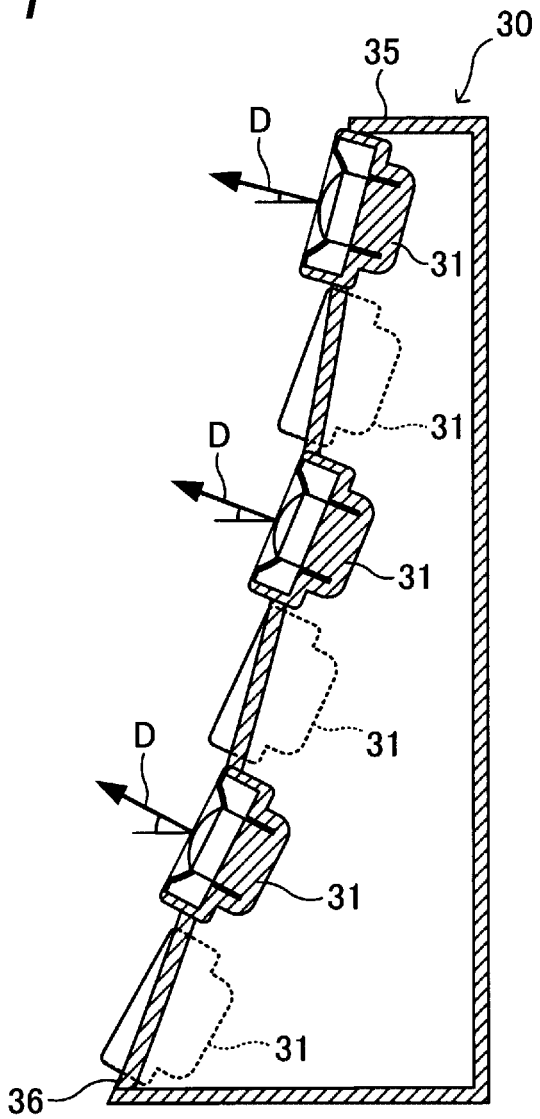
FIG. 11 illustrates a height speaker array unit according to a sixth embodiment.

As illustrated in FIG. 11, the disposition plane 36 of the cabinet 35 is curved to be positioned on the back side of the speaker array apparatus 1 in the upper part (that is, to be farther from the listening position in the upper part than the lower part).

In addition, in the height speaker array unit 30 according to the sixth embodiment, each speaker 31 is fixed to make the predetermined angle on the inclined disposition plane 36. Therefore, as illustrated in FIG. 11, each speaker 31 which configures the height speaker array unit 30 is disposed on the disposition plane 36 of the cabinet 35 so that the appropriate output direction D makes the elevation angle (that is, the upward angle with respect to the horizontal direction). Since each speaker 31 is disposed on the curved disposition plane 36, each speaker 31 is disposed so that the elevation angle made by the appropriate output direction D of each speaker 31 increases as much as the appropriate output direction D positioned at the lower part.

As described above, in the sixth embodiment, on the disposition plane 36 of the cabinet 35, since the height speaker array unit is configured to dispose six speakers 31 in a zigzag arrangement in a front view, compared to the case of the fifth embodiment, in a state where the elevation angle made by the appropriate output direction D of each speaker 31 is large, it is possible to fix each speaker 31 on the disposition plane 36. Therefore, according to the speaker array apparatus 1 according to the sixth embodiment, compared to the fifth embodiment, it is possible to increase the sound pressure of the sound beam to the ceiling CE side, and to reduce the sound pressure which is oriented to the listening position side.

In addition, in the speaker array apparatus 1 according to the sixth embodiment, since each speaker 31 of the height speaker array unit 30 is disposed on the curved disposition plane 36 to be farther from the listening position in the upper part than the lower part so that the appropriate output direction D makes the elevation angle, it is possible to increase the sound pressure of the sound beam which is oriented to the ceiling CE side, and to reduce the sound pressure which is oriented to the listening position side for the entire height speaker array unit 30.

As described above, similar to the speaker array apparatus 1 according to the above-described embodiments, the speaker array apparatus 1 according to the sixth embodiment includes the height speaker array unit 30, distributes the sound signal input from the outside to the plurality of speakers 31 that configure the height speaker array unit 30, and controls the output timing of the sound output from the speaker. Accordingly, it is possible to output the sound beam of the height channel which is oriented to the listening position from the upper position (refer to FIG. 2B).

According to the speaker array apparatus 1 according to the sixth embodiment, as illustrated in FIG. 11, since the speakers 31 which configure the height speaker array unit 30 are disposed on the disposition plane 36 of the cabinet 35 so that the appropriate output direction D makes the elevation angle (that is, the upward angle with respect to the horizontal direction), and each speaker 31 exhibits the sound pressure distribution illustrated in FIG. 3, when the sound beam related to the height channel is output, it is possible to increase the sound pressure to the ceiling CE side and to reduce the sound pressure to the listening position on the apparatus front side, thereby enhancing the quality of the sound field expression by the height channel.

In addition, in the speaker array apparatus 1 according to the sixth embodiment, since the disposition plane 36 of the cabinet 35 is curved to be farther from the listening position in the upper part of the disposition plane 36 than the lower part, by disposing each speaker 31 on the disposition plane 36, it is possible to be in a state where the appropriate output direction D makes the elevation angle, and when the sound beam related to the height channel is output, it is possible to increase the sound pressure to the ceiling CE side, and to reduce the sound pressure to the apparatus front side for the entire speaker array.

In addition, according to the speaker array apparatus 1 according to the sixth embodiment, since each speaker 31 is disposed on the disposition plane 36 so that a larger elevation angle is made in the lower part of the height speaker array unit 30 than the upper part, when the sound beam related to the height channel is output, it is possible to increase the sound pressure to the ceiling CE side and to reduce the sound pressure to the apparatus front side for the entire speaker 31, thereby enhancing the quality of the sound field expression by the height channel.

Furthermore, in the speaker array apparatus 1 according to the sixth embodiment, speakers 31 of the height speaker array unit 30 are disposed in a zigzag arrangement in a front view on the disposition plane 36. In other words, a certain speaker 31 of the height speaker array unit 30 is disposed at a position different in the horizontal direction on the disposition plane 36, with respect to the speakers 31 positioned at the upper part in the vertical direction. Accordingly, since it is possible to avoid the interference by the speakers positioned at the upper part, compared to the fifth embodiment, the speaker array apparatus 1 according to the sixth embodiment can increase the elevation angle of the appropriate output direction D in each speaker 31, and to further enhance the quality of the sound field expression by the height channel. In addition, since it is possible to narrow the pitch of the speakers 31 related to the vertical direction, according to the speaker array apparatus 1, it is possible to ensure the directivity in a high frequency zone regarding the sound output from the height speaker array unit 30.

Seventh Embodiment

Next, an embodiment (seventh embodiment) which is different from the above-described embodiments will be described in detail with reference to FIG. 12. The speaker array apparatus 1 according to the seventh embodiment has a basic configuration which is substantially the same as that of the speaker array apparatus 1 according to each of the above-described embodiments, and has a different configuration of the height speaker array unit 30. Regarding the configuration which is the same as those of the above-described embodiments, the description thereof will be omitted, and the configuration related to the difference will be described in detail.

(Specific Configuration of Height Speaker Array Unit 30 According to Seventh Embodiment)

Next, a specific configuration of the height speaker array unit 30 according to the seventh embodiment will be described in detail with reference to the accompanying drawings. FIG. 12 is a side sectional view illustrating the configuration of the height speaker array unit 30 according to the seventh embodiment.

Similar to the second embodiment, the height speaker array unit 30 according to the seventh embodiment is configured so that six speakers 31 are disposed in a zigzag arrangement in the vertical direction in a front view on the disposition plane 36 of the cabinet 35. Furthermore, in this case, the height position of each speaker 31 is a position similar to the height of each speaker 31 in the first embodiment.

In addition, on the disposition plane 36 of the cabinet 35, the horn 37 is formed in each speaker 31 which configures the height speaker array unit 30. The horn 37 is a part where the disposition plane 36 is formed in a recessed shape toward the back side of the cabinet 35, and is inclined so that each horn 37 is closer to the listening position side in the upper part than the lower part. In the lower portion of the horn 37, each of the speakers 31 is disposed so that the appropriate output direction D makes the elevation angle (refer to FIG. 12).

Therefore, according to the height speaker array unit 30 according to the seventh embodiment, similar to the second embodiment, by disposing speakers 31 in a zigzag arrangement on the disposition plane 36 in a front view, and by forming each horn 37, it is possible to avoid the interference by the presence of speakers 31 positioned at the upper part. As illustrated in FIG. 12, each speaker 31 which configures the height speaker array unit 30 is disposed in the lower portions of each horn 37 on the disposition plane 36 so that the appropriate output direction D makes the elevation angle (that is, the upward angle with respect to the horizontal direction). Therefore, according to the height speaker array unit 30, while avoiding the interference of the sound wave, it is possible to increase the sound pressure to the ceiling CE side, and to reduce the sound pressure to the apparatus front side.

Furthermore, in the seventh embodiment, the sound insulating board member 38 is formed to be integrated with the horn 37 by extending the upper end portions of each horn 37. Similar to the third embodiment, each sound insulating board member 38 is a board-shaped member which is disposed to protrude from the lower part of the speaker 31 and to cover the lower portion of the speaker 31, and suppresses the sound which is directly transferred to the listening position from the speakers 31. Accordingly, according to the speaker array apparatus 1, since it is possible to reduce the sound pressure in the direction (horizontal direction) toward the listening position where effectiveness regarding the sound beam of the height channel is low, the sound beam related to the height channel can be efficiently used.

As described above, similar to the speaker array apparatus 1 according to the above-described embodiments, the speaker array apparatus 1 according to the seventh embodiment includes the height speaker array unit 30, distributes the sound signal input from the outside to the plurality of speakers 31 that configure the height speaker array unit 30, and controls the output timing of the sound output from the speaker. Accordingly, it is possible to output the sound beam of the height channel which is oriented to the listening position from the upper position (refer to FIG. 2B).

Figure 12:
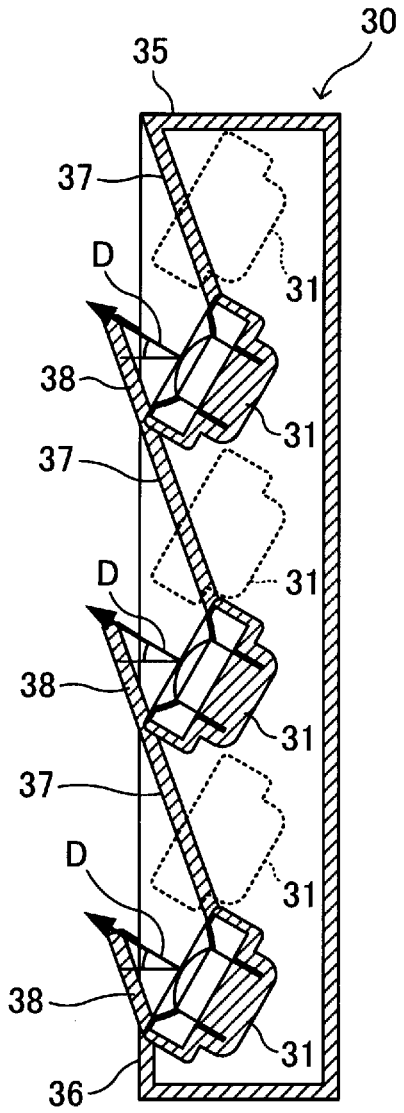
FIG. 12 illustrates a height speaker array unit according to a seventh embodiment.

According to the speaker array apparatus 1 according to the seventh embodiment, as illustrated in FIG. 12, since the speakers 31 which configure the height speaker array unit 30 are disposed on the disposition plane 36 of the cabinet 35 so that the appropriate output direction D makes the elevation angle (that is, the upward angle with respect to the horizontal direction), and each speaker 31 exhibits the sound pressure distribution illustrated in FIG. 3, when the sound beam related to the height channel is output, it is possible to increase the sound pressure to the ceiling CE side and to reduce the sound pressure to the listening position on the apparatus front side, thereby enhancing the quality of the sound field expression by the height channel.

In addition, as illustrated in FIG. 12, in the speaker array apparatus 1 according to the seventh embodiment, with respect to each speaker 31 of the height speaker array unit 30, the sound insulating board member 38 which serves as the suppression member is disposed to be integrated with each horn 37, protrudes from the lower part of the speaker, and covers the lower portion of the speaker. In each sound insulating board member 38, in order to suppress the sound which is directly transferred to the listening position from the speakers 31, according to the speaker array apparatus 1, since it is possible to reduce the sound pressure in the direction (horizontal direction) toward the listening position where the effectiveness regarding the sound beam of the height channel is low, the sound beam related to the height channel can be efficiently used.

Furthermore, in the speaker array apparatus 1 according to the seventh embodiment, the speakers 31 of the height speaker array unit 30 are disposed in a zigzag arrangement in a front view on the disposition plane 36. In other words, a certain speaker 31 of the height speaker array unit 30 is disposed at a position different in the horizontal direction on the disposition plane 36, with respect to the speakers 31 positioned at the upper part in the vertical direction, and it is possible to avoid the interference by the speakers positioned at the upper part. For this reason, the speaker array apparatus 1 according to the sixth embodiment can enhance the quality of the sound field expression by the height channel. In addition, since it is possible to narrow the pitch of the speakers 31 related to the vertical direction, according to the speaker array apparatus 1, it is possible to ensure the directivity in a high frequency zone regarding the sound output from the height speaker array unit 30.

The present invention is described based on the above embodiments, but the present invention is not limited to any of the above-described embodiments, and various improvements and changes are possible without departing from the main idea of the present invention. For example, in the above-described embodiments, the speaker array apparatus 1 includes the speaker array unit 20 for performing the sound field expression in the horizontal direction, and the height speaker array unit 30 for performing the sound field expression in the height (perpendicular) direction, in the apparatus body 1A, but the invention is not limited to this aspect. For example, it is also possible to employ a configuration in which only the height speaker array unit 30 is provided without the speaker array unit 20.

In the above-described embodiments, the height speaker array unit 30 is configured by disposing six speakers 31 across the vertical direction, but the number of speakers 31 which configure the height speaker array unit 30 is not limited thereto. According to the requirements, such as performance of the sound field expression in the speaker array apparatus 1, it is possible to appropriately change the number of the speakers 31.

In addition, in the above-described embodiments, the height speaker array unit 30 shows an aspect in which each speaker 31 is disposed in a straight line which extends in the vertical direction (for example, FIG. 6A or the like), or an aspect in which each speaker 31 is disposed in a zigzag arrangement in the vertical direction (for example, FIG. 7A or the like), but the invention is not limited to the aspects. Regarding the position related to the horizontal direction of the disposition plane 36, various aspects can be employed if a position of a certain speaker 31 and a position of a speaker 31 positioned immediately above the certain speaker 31 are different from each other.

Figure 13:
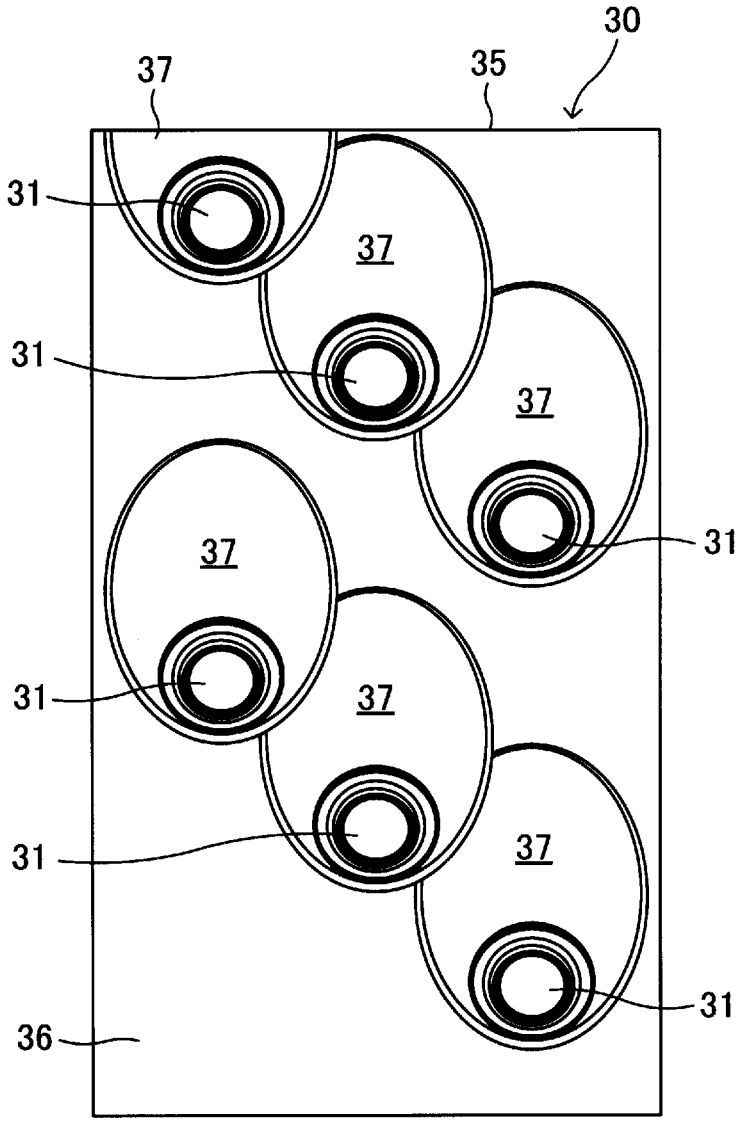
FIG. 13 is a front view illustrating a modification example (1) of the height speaker array unit.

For example, it is possible to dispose speakers 31 along the vertical direction while using three or more positions regarding the horizontal direction on the disposition plane 36. Specifically, regarding the horizontal direction on the disposition plane 36, an aspect in which three or more positions are used is described. For example, as illustrated in FIG. 13, a configuration in which a pattern of forming the speakers 31 and the cabinet 35 to be gradually downward from one side to the other side in the horizontal direction of the disposition plane 36 is repeated along the vertical direction of the disposition plane 36 is possible.

Figure 14:
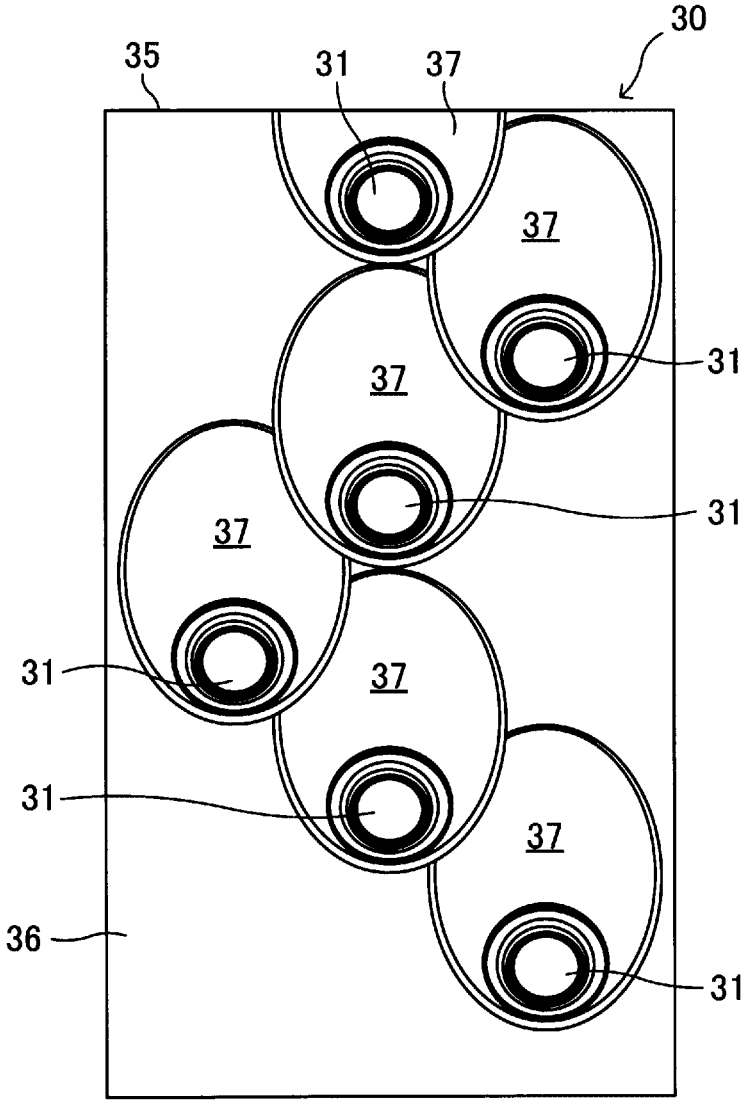
FIG. 14 is a front view illustrating a modification example (2) of the height speaker array unit.

Alternatively, as illustrated in FIG. 14, it is also possible to form the plurality of speakers 31 and the plurality of horns 37 while using three or more positions related to the horizontal direction on the disposition plane 36, in a zigzag arrangement in the vertical direction. Even when each speaker 31 is disposed in the height speaker array unit 30 as illustrated in FIGS. 13 and 14, since it is possible to narrow the pitch of the speakers 31 related to the vertical direction, according to the speaker array apparatus 1, it is possible to ensure the directivity in a high frequency zone regarding the sound output from the height speaker array unit 30.

the speaker array apparatus 1 in each of the above-described embodiments is an example of the speaker array apparatus of the present invention. The cabinet 35 is an example of the apparatus housing of the present invention. The disposition plane 36 is an example of the disposition plane of the present invention. The height speaker array unit 30 is an example of the speaker array of the present invention. The speaker 31 is an example of the speaker of the present invention. The appropriate output direction D is an example of the appropriate output direction of the present invention. The sound insulating board member 38 and the suppression member 39 are an example of the suppression member of the present invention. The sound insulating board member 38 is an example of the sound insulating board of the present invention, and the net portion 39A is an example of the net portion of the present invention.

REFERENCE SIGNS LIST

1: speaker array apparatus
1A: apparatus body
10: system controller
15: beam forming portion
30: height speaker array unit
31: speaker
35: cabinet
36: disposition plane
38: sound insulating board member
39: suppression member
39A: net member
D: appropriate output direction

What is claimed is:

1. A speaker array apparatus comprising:

an apparatus housing having a disposition plane and a plurality of speaker position axes running laterally across the apparatus housing perpendicular to the disposition plane; and a speaker array which includes a plurality of speakers, each speaker of the speaker array disposed relative to a respective speaker position axis, and the speakers disposed at least in a vertical direction on the disposition plane of the apparatus housing that is opposite to a listening position, wherein no two or more speakers of the plurality of speakers are disposed on a same speaker position axis, wherein:

the speaker array apparatus receives and distributes a sound signal input from an outside to all of or a part of the speakers of the speaker array, and outputs the distributed sound signal as a sound beam by controlling an output timing of each sound output from the all or part of the speakers, and each speaker of the speaker array has an appropriate output direction in an elevation angle, the appropriate output direction indicating a direction having a highest sound pressure in a sound pressure distribution when the sound is output from the speaker, and the speakers of the speaker array are disposed on the disposition plane in a zig-zag arrangement in the vertical direction.

2. The speaker array apparatus according to claim 1, wherein a lower-positioned speaker of the speaker array has the appropriate output direction in an elevation angle larger than a higher-positioned speaker of the speaker array.

3. The speaker array apparatus according to claim 1, wherein the disposition plane of the apparatus housing is inclined to be farther from the listening position at an upper part of the disposition plane than at a lower part of the disposition plane.

4. The speaker array apparatus according to claim 1, wherein the disposition plane of the apparatus housing is curved to be farther from the listening position at an upper part of the disposition plane than at a lower part of the disposition plane.

5. The speaker array apparatus according to claim 1, further comprising:

a suppression member which suppresses a sound directly transferred to the listening position from the speakers.

6. The speaker array apparatus according to claim 5, wherein the suppression member is configured of a sound insulating board which protrudes from a lower part of the speaker and covers a lower portion of the speaker.

7. The speaker array apparatus according to claim 5, wherein the suppression member includes a net portion provided nearer to the listening position side than the disposition plane on an upper side than a horizontal direction of each speaker, wherein the net portion has a higher aperture ratio than that of a portion of the suppression member in the horizontal direction of the speaker.

8. The speaker array apparatus according to claim 1, wherein each speaker of the speaker array is disposed at a position which is different in the horizontal direction on the disposition plane, with respect to a speaker positioned at an upper part of each speaker in the vertical direction of the speaker array.

9. The speaker array apparatus according to claim 1, further comprising:

a horn provided on the disposition plane of the apparatus housing for each speaker of the speaker array.

10. The speaker array apparatus according to claim 1, wherein the disposition plane of the speaker array is a vertical plane.

11. A speaker array apparatus comprising:

an apparatus housing having a disposition plane and a plurality of speaker position axes running laterally across the apparatus housing perpendicular to the disposition plane;

a speaker array which includes a plurality of speakers, each speaker of the speaker array disposed relative to a respective speaker position axis, and the speakers disposed in a zigzag arrangement in a vertical direction on the disposition plane of the apparatus housing that is opposite to a listening position, wherein no two or more speakers of the plurality of speakers are disposed on a same speaker position axis; and horns provided on the disposition plane of the apparatus housing for the speakers of the speaker array, wherein the speaker array apparatus receives and distributes a sound signal input from an outside to all of or a part of the speakers of the speaker array, and outputs the distributed sound signal as a sound beam by controlling an output timing of each sound output from the all or part of the speakers, and each speaker of the speaker array has an appropriate output direction in an elevation angle and an upward angle with respect to a horizontal direction, the appropriate output direction indicating a direction having a highest sound pressure in a sound pressure distribution when the sound is output from the speaker.

* * * * *